US007950076B2

(12) United States Patent
Koren

(10) Patent No.: US 7,950,076 B2
(45) Date of Patent: May 31, 2011

(54) SPA COVER LIFTER

(75) Inventor: George F Koren, Evergreen, CO (US)

(73) Assignee: Nerok LLC, Evergreen, CO (US)

( * ) Notice: Subject to any disclaimer, the term of this patent is extended or adjusted under 35 U.S.C. 154(b) by 996 days.

(21) Appl. No.: 11/565,214

(22) Filed: Nov. 30, 2006

(65) Prior Publication Data

US 2007/0210290 A1 Sep. 13, 2007

Related U.S. Application Data

(63) Continuation-in-part of application No. 11/353,420, filed on Feb. 14, 2006, now Pat. No. 7,500,276, which is a continuation-in-part of application No. 11/101,231, filed on Apr. 7, 2005, now Pat. No. 7,308,722.

(51) Int. Cl.
*E04H 4/00* (2006.01)

(52) U.S. Cl. ..... 4/498

(58) Field of Classification Search ..... 4/494, 498–500
See application file for complete search history.

(56) References Cited

U.S. PATENT DOCUMENTS

| | | | | |
|---|---|---|---|---|
| 645,890 | A | 3/1900 | Conrad | |
| 1,451,619 | A * | 4/1923 | Latrace | 160/189 |
| 1,658,044 | A | 2/1928 | Fagan | |
| 2,847,720 | A | 8/1958 | Hamm | |
| 2,980,921 | A * | 4/1961 | Bartolucci | 4/500 |
| 3,002,195 | A * | 10/1961 | Prudek | 4/494 |
| 3,021,530 | A | 2/1962 | Sears | |
| 3,060,520 | A | 10/1962 | Schutmaat | |
| 3,207,208 | A * | 9/1965 | Houk et al. | 160/189 |
| 3,344,837 | A * | 10/1967 | Young | 160/189 |
| 3,822,420 | A * | 7/1974 | Kindness | 4/500 |
| 4,991,238 | A | 2/1991 | Forrest | |
| 5,044,132 | A | 9/1991 | Harman | |
| 5,048,153 | A | 9/1991 | Wall et al. | |
| 5,131,102 | A | 7/1992 | Salley et al. | |
| 5,471,685 | A | 12/1995 | Cross | |
| 5,517,703 | A | 5/1996 | Ouelette | |
| 5,566,403 | A | 10/1996 | Black et al. | |
| 5,584,081 | A | 12/1996 | Ouelette | |
| 5,621,926 | A | 4/1997 | La Madeleine | |
| 5,634,218 | A | 6/1997 | Ouelette | |

(Continued)

FOREIGN PATENT DOCUMENTS

WO WO 2006/110468 A2 10/2006

OTHER PUBLICATIONS

International Search Report and Written Opinion, PCT US/2006/12865, dated Mar. 13, 2007 (3 pages).

(Continued)

*Primary Examiner* — Charles Phillips
(74) *Attorney, Agent, or Firm* — K&L Gates LLP

(57) ABSTRACT

A spa cover lifter for use with a spa cover. According to various embodiments, the spa cover comprises a first section and a second section pivotably connected to the first section at a hinge interface. The spa cover lifter comprises a drive system, a first cable connected to the drive system, and a post assembly. The post assembly is extendable from a retracted position to an extended position. Also, the first cable is routed by the post assembly. In various embodiments, the spa cover lifter is configured to connect to the spa cover.

6 Claims, 40 Drawing Sheets

U.S. PATENT DOCUMENTS

| | | | | |
|---|---|---|---|---|
| 5,644,803 | A | | 7/1997 | Wilson |
| 5,689,841 | A | | 11/1997 | Black et al. |
| 5,819,332 | A | | 10/1998 | Perry |
| 5,909,921 | A | | 6/1999 | Nesbeth |
| 5,950,252 | A | | 9/1999 | Fettes |
| 5,974,599 | A | | 11/1999 | Tudor |
| 5,974,600 | A | | 11/1999 | Pucci et al. |
| 5,996,137 | A | | 12/1999 | Genova |
| 6,000,071 | A | | 12/1999 | Fettes |
| 6,000,072 | A | | 12/1999 | LaHay |
| 6,032,305 | A | | 3/2000 | Tedrick |
| 6,079,059 | A | | 6/2000 | Girerd |
| 6,158,063 | A | * | 12/2000 | Tudor ..... 4/500 |
| 6,381,766 | B1 | | 5/2002 | Perry |
| 6,393,630 | B1 | | 5/2002 | Tedrick |
| 6,550,077 | B1 | | 4/2003 | Tedrick |
| 6,601,834 | B2 | | 8/2003 | Perry |
| 6,634,036 | B2 | | 10/2003 | Tudor |
| 6,742,196 | B2 | | 6/2004 | LaHay |
| 6,795,984 | B1 | | 9/2004 | Brady |
| 6,842,917 | B1 | | 1/2005 | Genova |
| 7,308,722 | B2 | | 12/2007 | Koren |
| 7,500,276 | B2 | | 3/2009 | Koren |
| 2008/0060125 | A1 | | 3/2008 | Koren |
| 2010/0154111 | A1 | | 6/2010 | Koren |

OTHER PUBLICATIONS

Notice of Allowance mailed Mar. 14, 2007 in U.S. Appl. No. 11/101,231.

Notice of Allowance mailed Oct. 29, 2008 in U.S. Appl. No. 11/353,420.

Non-final Office Action mailed Mar. 18, 2009 in U.S. Appl. No. 11/982,057.

Non-final Office Action mailed Jul. 29, 2009 in U.S. Appl. No. 11/982,057.

* cited by examiner

SPA COVER LIFTER

CROSS-REFERENCE TO RELATED APPLICATIONS

This application is a continuation-in-part of prior U.S. application Ser. No. 11/353,420, filed Feb. 14, 2006, now U.S. Pat. No. 7,500,276, which is a continuation-in-part of prior U.S. application Ser. No. 11/101,231, filed Apr. 7, 2005 now U.S. Pat. No. 7,308,722

BACKGROUND

The application is related, generally and in various embodiments, to a spa cover lifter. Many people today enjoy the recreational benefits of soaking in the hot water of a hot-tub or spa. Spas are popular at gyms and other recreational facilities, and many people even maintain spas at their private homes. Most spas are shielded by bulky covers when not in use. Especially with outdoor spas, the covers are often necessary to retain heat energy in the spa. The covers may also prevent debris, such as leaves, grass clippings, etc., from falling into the spa.

Due to their insulating properties, spa covers are often bulky and can sometimes be quite heavy. Removing and replacing a spa cover can be a nuisance to larger individuals, but may be extremely difficult for those of slighter builds. Systems exist for automatically opening and replacing spa covers, however, these systems are not designed for opening common types of spa covers.

SUMMARY OF THE INVENTION

According to one general aspect, the present application discloses a spa cover lifter for lifting a spa cover. The spa cover may comprise a first section and a second section pivotably coupled to the first section at a hinge interface. The spa cover lifter may comprise a drive system coupled to the spa cover at the first section and proximate the hinge interface. The drive system may be configured to exert a first force on the first section and a second force proximate the hinge interface. The spa cover lifter may also comprise a torsion spring positioned at about the hinge interface. The torsion spring may be configured to release a torque tending to rotate the first section off of a spa about the interface until the first section is rotated off of the spa by a predetermined angle. Then, the torsion spring may be configured to store a torque tending to rotate the second section onto the spa about the hinge interface.

According to another general aspect, the present application discloses a spa cover lift-assist mechanism for assisting in lifting a spa cover. The lift-assist mechanism may comprise a first support member configured to be coupled to the first section of the spa cover and a second support member configured to be coupled to the second section of the spa cover, where the first support member and the second support member are coupled to one another at an interface. The lift-assist mechanism may also comprise a torsion spring configured to be positioned at the interface. The torsion spring may be configured to provide a torque tending to rotate the first section off of the spa about the hinge interface.

According to yet another general aspect, the present application discloses a spa cover lifter for lifting a spa cover. The spa cover lifter may comprise first, second and third frame members. The first frame member may be coupled to the first section of the spa cover. The second frame member may be coupled to the second section of the spa cover and may be pivotably coupled to the first frame member at about the hinge interface. The third frame member may be pivotably coupled to the second frame member at about an edge of the spa. The spa cover lifter may also comprise a drive system and a first cable extending from the drive mechanism to the first frame member.

DETAILED DESCRIPTION

Figure 1:
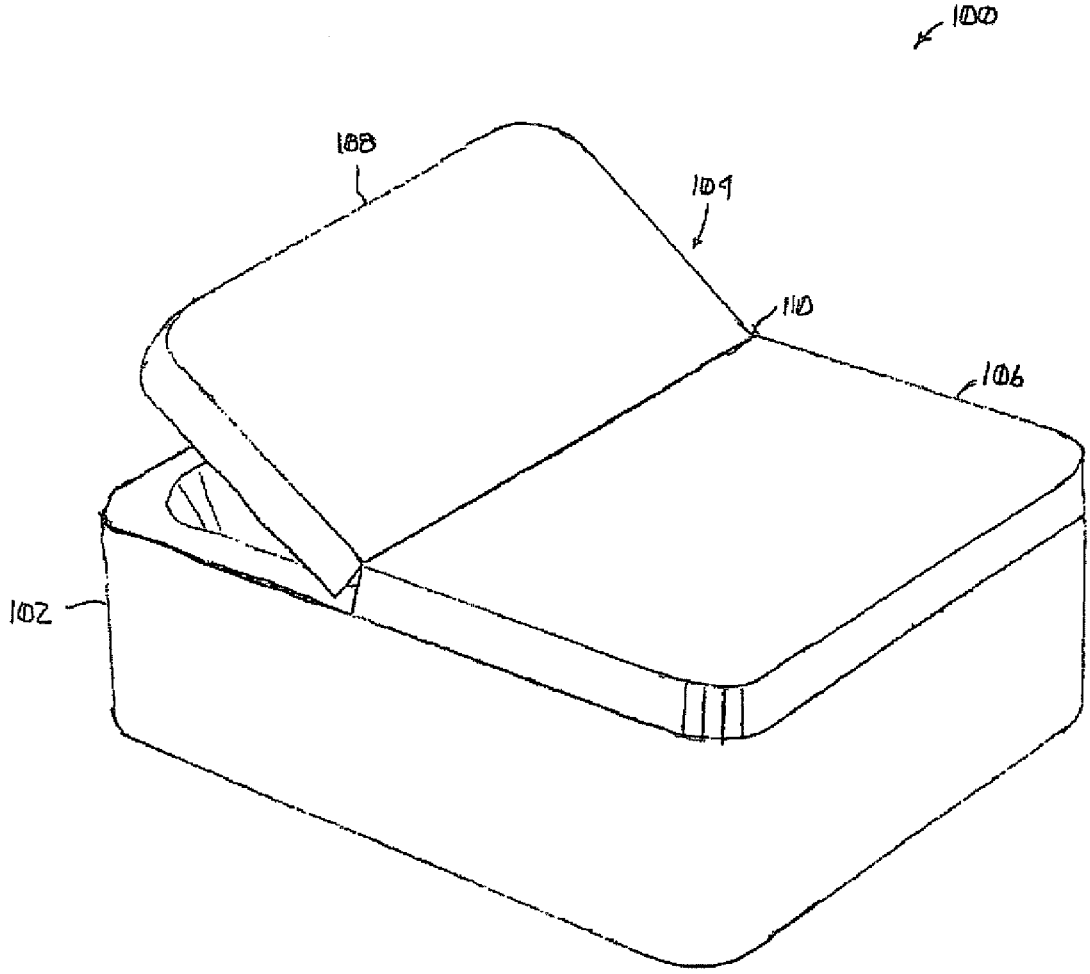
FIG. 1 illustrates a spa and spa cover according to various embodiments.

FIG. 1 illustrates a spa 100 according to various embodiments. The spa 100 may include a tub 102 and a cover 104. The tub 102 may be filled with water and, in various embodiments, may include filtration and heating equipment (not shown) as is known in the art. The spa cover 104 may include a core (not shown) made from a heat insulating material, such as, for example, polystyrene. The spa cover 104 may be covered in a waterproof lining, for example, made from vinyl or another suitable material. The cover 104 may include a first section 106 and a second section 108. The sections 106, 108 of the cover 104 may be pivotably joined at hinge interface 110. For example, the cover 104 may be folded at the hinge interface 110 as shown.

Figure 2:
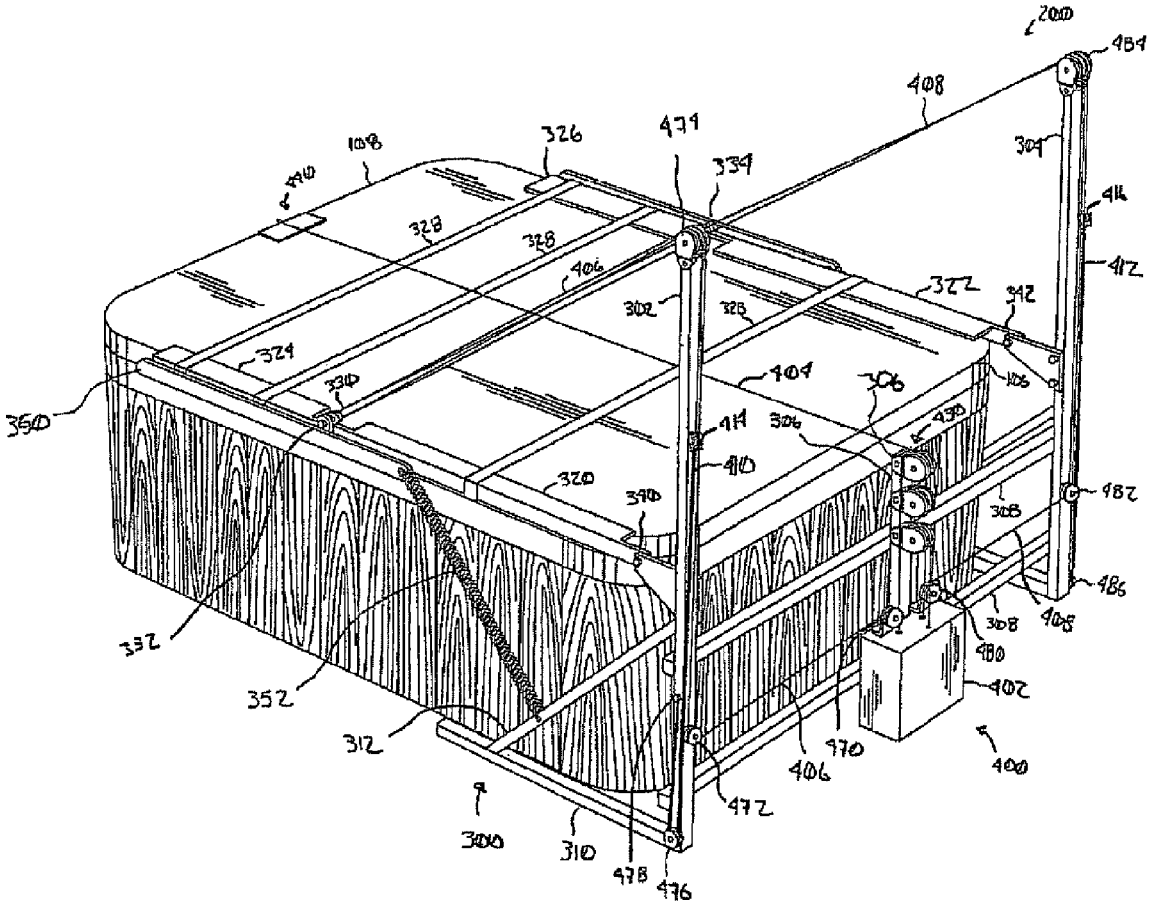
FIGS. 2-3 illustrate portions of a spa cover lifter installed on a spa according to various embodiments.
Figure 3:
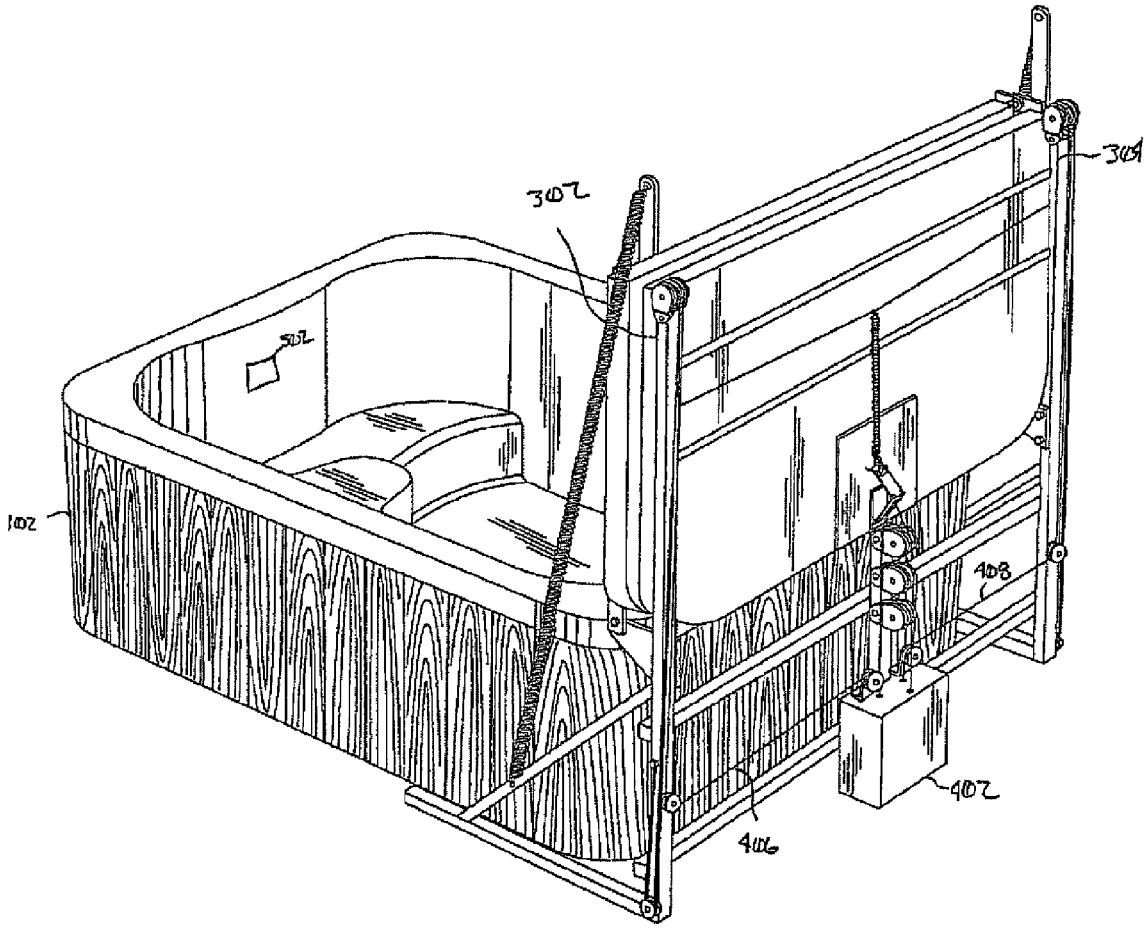

FIGS. 2-8 depict various components of a spa cover lifter 200 installed on a spa 100 according to various embodiments. The spa cover lifter 200 may generally include a frame structure 300 and a drive system 400. The spa cover lifter 200 may cause the spa cover 104 to transition between a closed position, for example, as shown in FIG. 2, and an open position, for example, as shown in FIG. 3. Referring back to FIG. 2, the frame structure 300 of the spa cover lifter 200 may include a pair of posts 302, 304 for example, positioned at adjacent corners of the spa 100. The side of the spa 100 between the adjacent corners may correspond to section 106 of the spa cover 104. In various embodiments, a drive post 306 may be positioned between the posts 302, 304. The posts 302, 304, 306 may be supported by any suitable support structure. For example, FIG. 1 shows the posts 302, 304, 306 supported by cross-members 308, stand 310 and brace 312.

In various embodiments, the posts 302, 304, 306 and structure 308, 310, 312 may be secured to the spa 100. For example, one or more of the structures 302, 304, 306, 308, 310, 312 may be fastened to the spa tub 102 using any suitable fastener or fasteners including, for example, one or more screws, nails, rivets, etc. Also, the above structures may be fastened to the spa tub 102 using straps (not shown) made of any suitable material.

The frame structure 300 of the spa cover lifter 200 may further include support members 320, 322, 324, 326 fastened to the spa cover 104 and also fastened to one or more of the posts 302, 304, 306, as described below. The support members 320, 322, 324, 326 may be fastened to the spa cover 104 using straps 328 or any other suitable fastening method. For example, the support members 320, 322, 324, 326 may be secured to the spa cover 104 using fasteners, e.g., screws, rivets, etc., however it will be appreciated that fastening methods that require puncturing the spa cover 104 may cause damage and premature wear to the cover 104.

In various embodiments, the support members 320, 322, 324, 326 may be fastened to opposite edges of the spa cover 104. The opposite edges may be roughly bisected by the hinge interface 110 such that support members 320, 322 may be fastened along opposite edges of the first section 106 of the spa cover 104 and support members 324, 326 may be fastened along opposite edges of the second section 108 of the spa cover 104.

A pole 330 may be positioned across the spa cover 104 at roughly the location of the hinge interface 110. The pole 330 may meet with the pair of support members 320, 324 at interface 332 such that the support members 320, 324 may pivot relative to each other about the interface 332. The pole 330 may also interface with the pair of support members 322, 326 at interface 334, similarly allowing the support members 324, 326 to pivot relative to each other. Accordingly, as the spa cover 104 is folded about the hinge interface 110, the support members 320, 322, 324, 326 may be similarly folded about the pole 330.

The support members 320, 322, 324, 326 and pole 330 may be pivotably connected to at least one of the posts 302, 304, 306, directly or indirectly. For example, support members 320 and 322 may be connected to posts 302, 304 at hinges 340, 342 as shown in FIG. 2. Accordingly, the support members 320, 322 as well as the attached spa cover 104 may be pivoted off the spa tub 102 at hinges 340, 342.

In various embodiments, the frame structure 300 may also include means for storing and releasing a torque about hinge interface 110, e.g., also about interfaces 332 and 334. For example, FIG. 2 shows a lever arm 350 attached to support member 324 and extending towards post 302, A spring 352 may extend from an end of lever arm 350 to brace 312 or another suitable portion of the frame structure 300. It will be appreciated that a similar lever arm and spring (not shown) may, but need not be, mounted on the opposite side of the spa 100. The lever arm 350 and spring 352 may store a torque by extending the spring 352 as the spa cover section 108 folds upon the spa cover section 106. The torque may be released as the spa cover sections 106, 108 unfold relative to each other and tension in the spring 352 is released.

Figure 4:
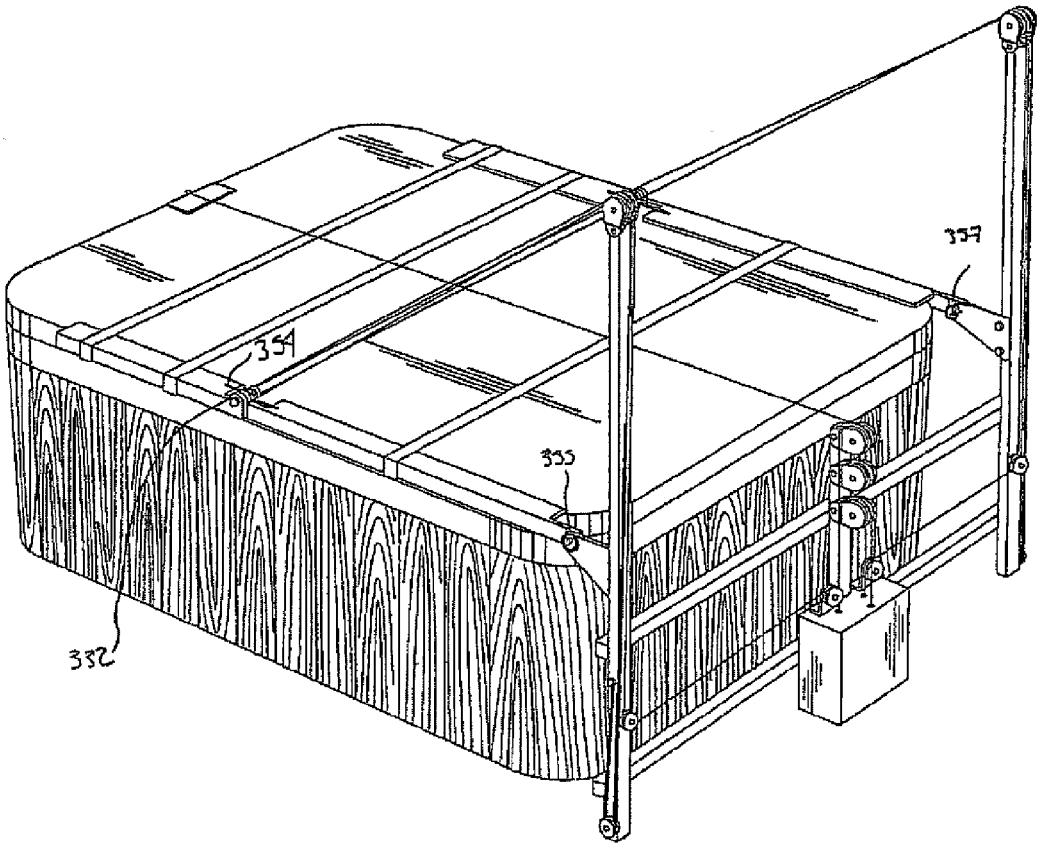
FIGS. 4-5 illustrate a torsion spring installed on a spa cover lifter according to various embodiments.
Figure 5:
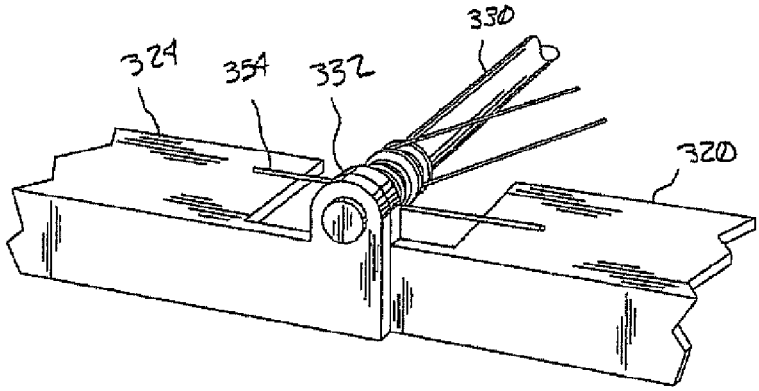

In various embodiments, the means for storing and releasing a torque may include a torsion spring 354 as shown in FIGS. 4 and 5. A similar torsion spring (not shown) may, but need not be, mounted on the opposite side of the spa 100. As the support members 320 and 324 fold upon one another, the torsion spring 354 may be compressed. Accordingly, as the sections 106, 108 of the spa cover 104 fold upon one another, a torque is stored in the torsion spring. The torque may be released as the spa cover 104 unfolds, and the tension in the torsion spring 354 is released. In certain embodiments, torsion springs 355, 357 or other means for storing and releasing a torque, e.g., a lever arm and spring, etc., may be included about hinges 340 and 342 as well.

Referring back to FIG. 2, the spa cover lifter 200 may also include a drive system 400. The drive system 400 may include a drive mechanism 402 for providing power to the spa lifter 200. The drive mechanism 402 may be mounted to the drive post 306, and may provide power to the spa cover lifter 200 by retracting a series of cables 404, 406, 408 attached directly or indirectly to the spa cover 104. The drive mechanism 402 may be any kind of drive device including, for example, an electric motor, an internal combustion engine, etc. In various embodiments, the drive mechanism 402 may include an electric motor whose operating voltage is chosen to match that of the spa 100, e.g., 110 volts or 220 volts. This may allow the drive mechanism 402 to draw power from the spa 100.

Figure 6:
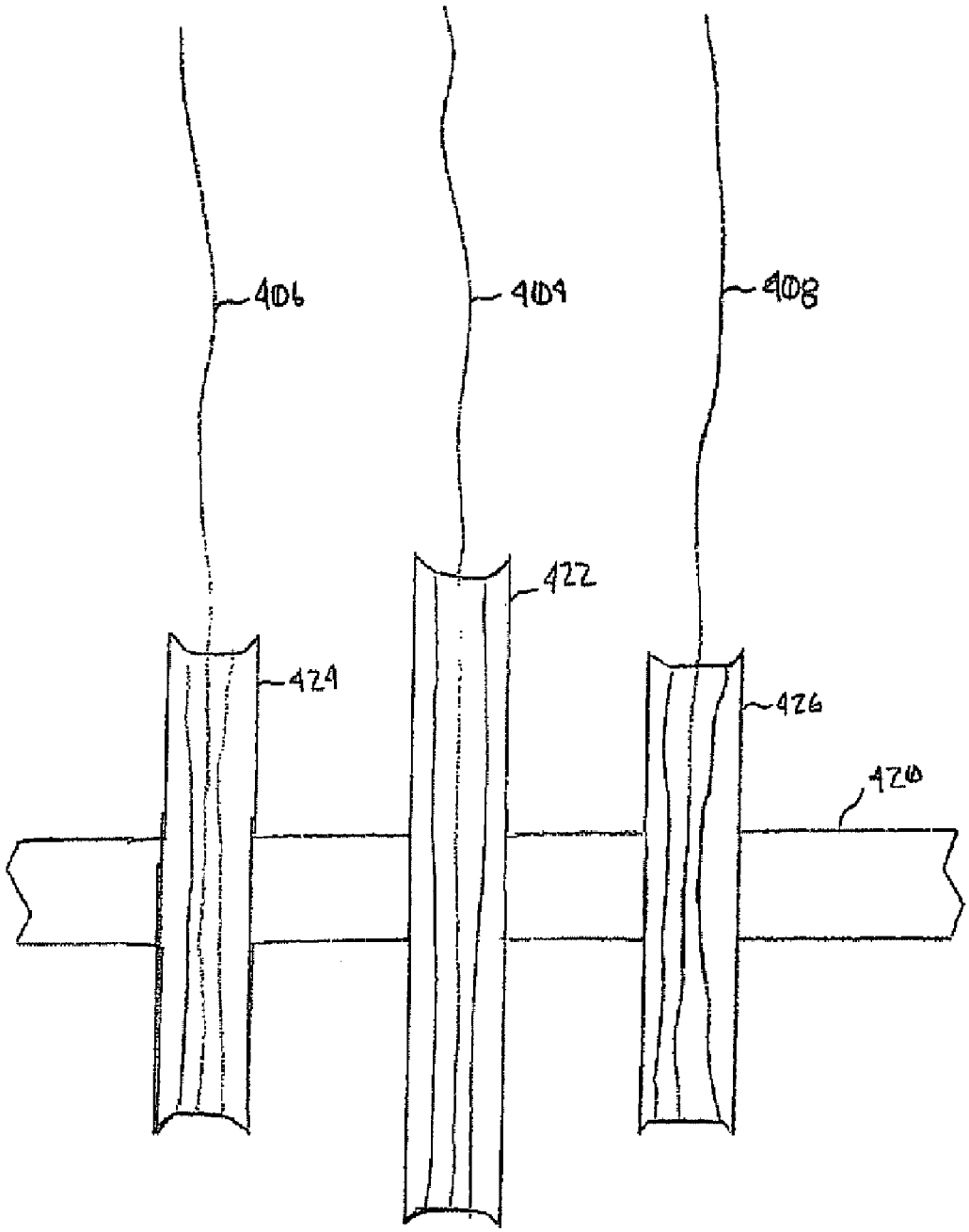
FIG. 6 illustrates a driveshaft for inclusion in a spa cover lifter according to various embodiments.

Cables 404, 406, 408 may extend, directly or indirectly, from the drive mechanism 402 to various points on the spa cover 104. FIG. 6 shows a driveshaft 420 that may be a part of the drive mechanism 402 according to various embodiments. The driveshaft 420 may include one or more spools 422, 424, 426. Each spool 422, 424, 426 may be connected to one or more of cables 404, 406, 408. As the driveshaft 420 rotates, the spools 422, 424, 426 may also rotate, causing the cables 404, 406, 408 to be retracted. In various embodiments, as described below, the spool 422 attached to the cable 404 may have a larger diameter than the spools 424, 426 attached to cables 406 and 408.

Figure 6A:
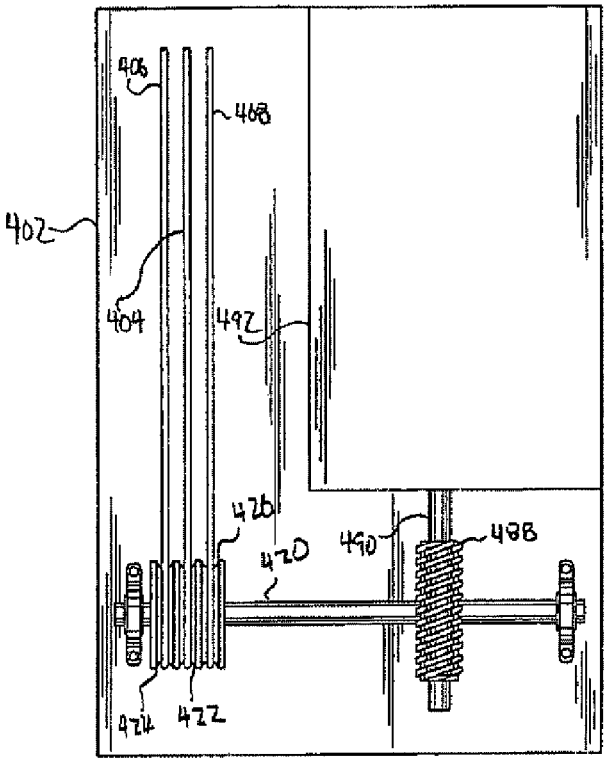
FIGS. 6A and 6B illustrate a drive mechanism for inclusion in a spa cover lifter according to various embodiments.
Figure 6B:
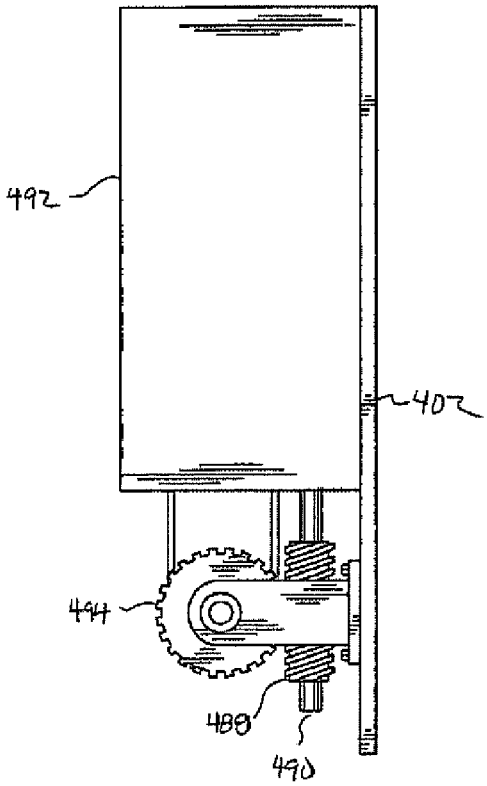
Figure 14:
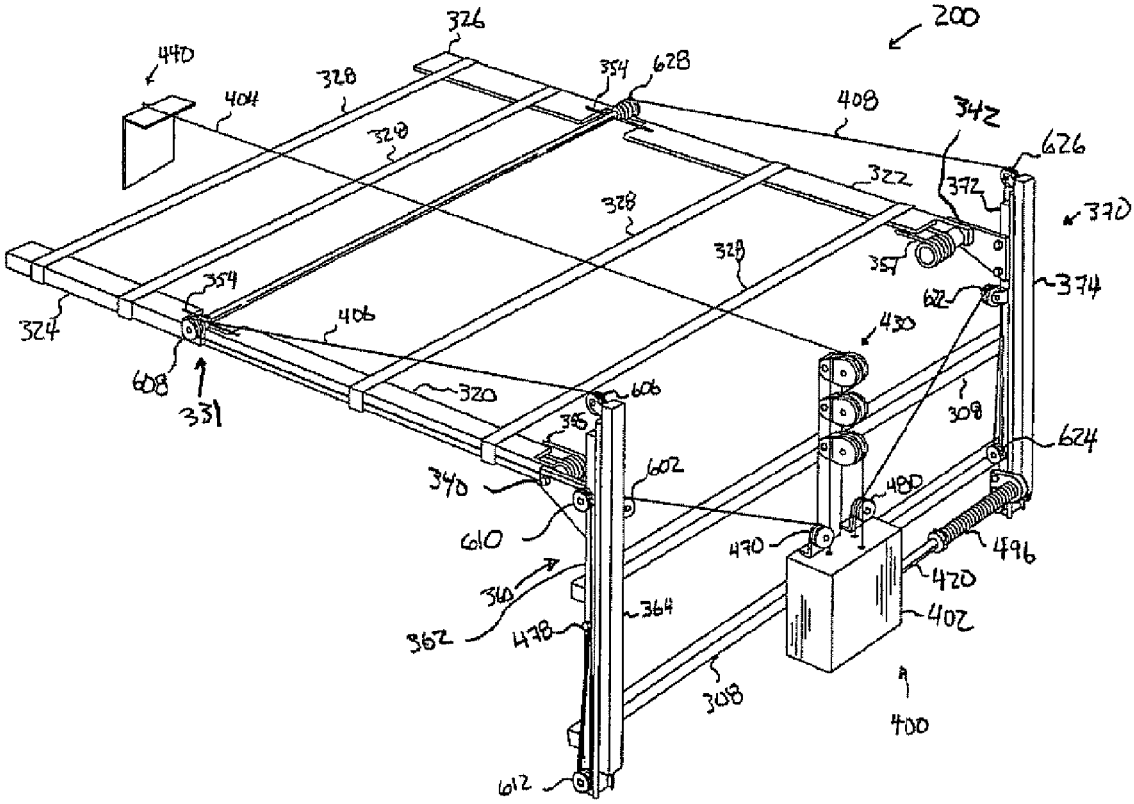
FIG. 14 illustrates portions of a spa cover lifter according to various embodiments.

FIGS. 6A and 6B show an exemplary drive mechanism 402 including a worm gear drive according to various embodiments. A motor 492 is shown having a motor shaft 490. The motor shaft 490 may have a worm gear 488 configured to interface a gear 494 that is operably connected to the driveshaft 420. In operation, the motor 492 causes the motor shaft 490 and worm gear 488 to rotate. The rotation of the worm gear 488 causes gear 494, driveshaft 420, and spools 422, 424, 426 to rotate, extending or reeling in the respective cables 404, 406 and 408. It will be appreciated that the drive mechanism 402 may cause rotation of the drive shaft 420 according to any suitable method. For example, in one non-limiting embodiment, the motor 492 and driveshaft 420 may be coupled with a drive chain (not shown). Also, the drive mechanism 402 may include a torsion spring 496 positioned at the driveshaft 420, as shown in FIG. 14, to provide the drive mechanism 402 with a load counterbalance.

The cable 404 may be routed by one or more pulleys, e.g., pulley assembly 430, from the drive mechanism 402 to the spa cover 104. The cable 404 may be fastened to the spa cover 104, for example, through an interface assembly 440. The interface assembly 440 may be mounted to an edge of the spa cover 104 opposite the drive mechanism 402. For example, if the drive mechanism 402 is placed adjacent to side 106 of the cover 104 the interface assembly 440 may be placed adjacent to section 108, as shown in FIG. 2. For example, the interface assembly 440 may be placed along an edge of section 108 opposite the hinge interface 110.

Figure 7:
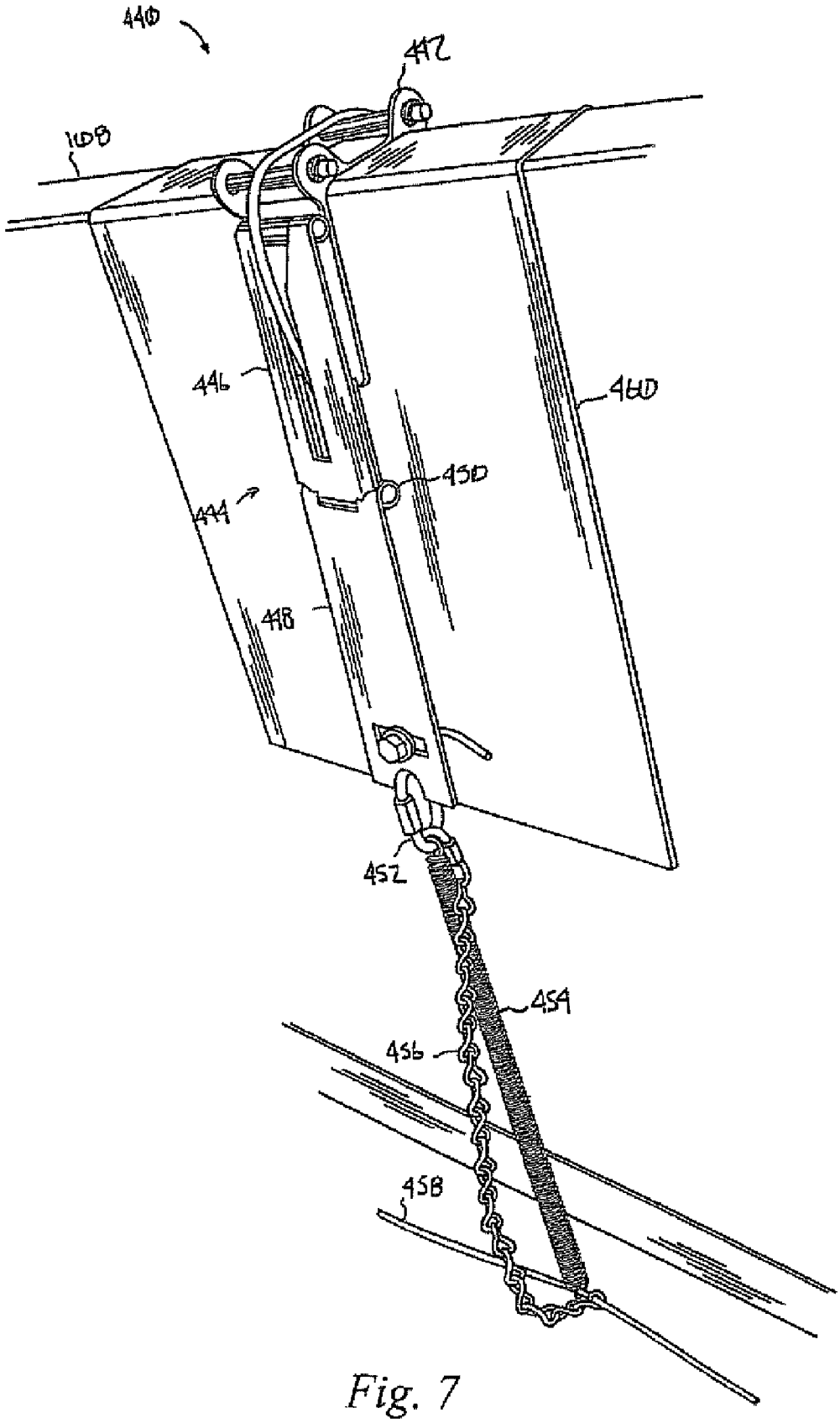
FIGS. 7-13 illustrate portions of a spa cover lifter installed on a spa according to various embodiments.
Figure 8:
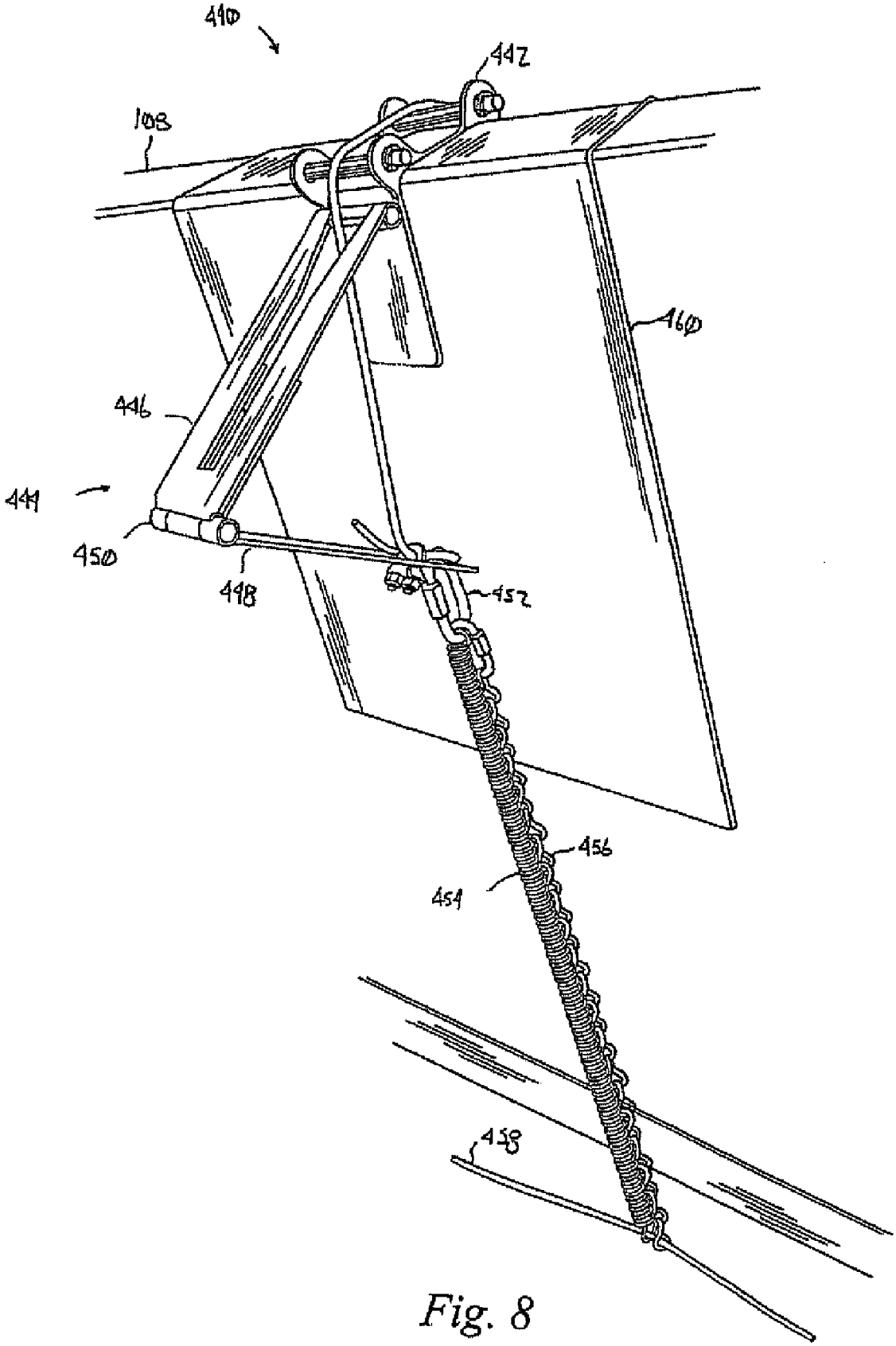

FIGS. 7 and 8 show embodiments of the interface assembly 440. The interface assembly 440 may include a bracket 442, an interface device 444 (including a first section 446, a second section 448 and a hinge 450), a connector 452, a spring 454, a chain 456, a cable 458, and a plate 460. The plate 460 may be placed between section 108 of the spa cover 104 and the various other components of the interface assembly 440. The hinge 450 of the interface device 444 may join the first section 446 and the second section 448, allowing the two sections 446, 448 to pivot relative to each other. It will be appreciated that the interface device 444 may be mounted perpendicular to an edge of the section 108 as pictured in FIGS. 7 and 8, or may, in various embodiments, be mounted parallel to the edge of the section 108.

The cable 404 may meet the interface assembly 440 at interface bracket 442. Interface bracket 442 may route the cable 404 around section 108 of the spa cover 104 and through interface device 444, where it may be attached to connector 452 attached to the second section 448 of the interface device 444. The spring 454 and chain 456 may also be attached to the connector 452. The ends of the spring 454 and chain 456 not attached to the connector 452 may be secured to the spa cover 104 and/or frame structure 300, for example, by cable 458. In various embodiments, the unextended length of the spring 454 may be shorter than the length of the chain 456.

When the spa cover 104 is in a closed position, the interface device 444 may lie flat between the section 108 of the spa cover 104 and the spa tub 102. As the cable 404 is retracted, for example, by the drive mechanism 402, the second section 448 of the interface device 444 may be drawn towards the first 446, extending the spring 454 and causing the two sections 446, 448 of hinge 450 to bend. As a result, a force may be exerted between the section 108 of the spa cover 104 and the spa tub 102. This may cause the section 108 to raise and pivot relative the section 106 of the spa cover 104. The motion of the interface device 444 may continue until chain 334 is engaged, arresting further motion of the hinge assembly 450.

Referring back to FIG. 2, in various embodiments, the cable 406 may extend from the drive mechanism 402 to the interface 332 between the pole 330, and the support members 320, 324. After exiting the drive mechanism 402, the cable 406 may be routed towards the post 302 by pulley 470. Pulley 472 may route the cable 406 toward the top of the post 302 where post pulley 474 may route the cable 406 toward interface 332. At interface 332, the cable 406 may be routed back towards post pulley 474. For example, the cable 406 may be wrapped around the pole 330 and/or a pulley (not shown) generally positioned near interface 332. Back at post pulley 474, the cable 406 may be routed down the post 302 to pulley 476, which may route the cable 406 up the post 302 to termination point 478. In various embodiments, the cable 406 may include an elastic section 408, for example, extending between the post pulley 474 and the termination point 478. It will be appreciated that the cable 408 may be routed similarly to the cable 406. For example, the cable 408 may extend through pulleys 480, 482, 484, to interface 334. From interface 334, the cable 408 may route back to the pulley 484, through pulley 486, and be connected to the frame structure 300 at a termination point (not shown). The cable 408 may also have an elastic section 412 similar to that of the cable 406.

Figure 9:
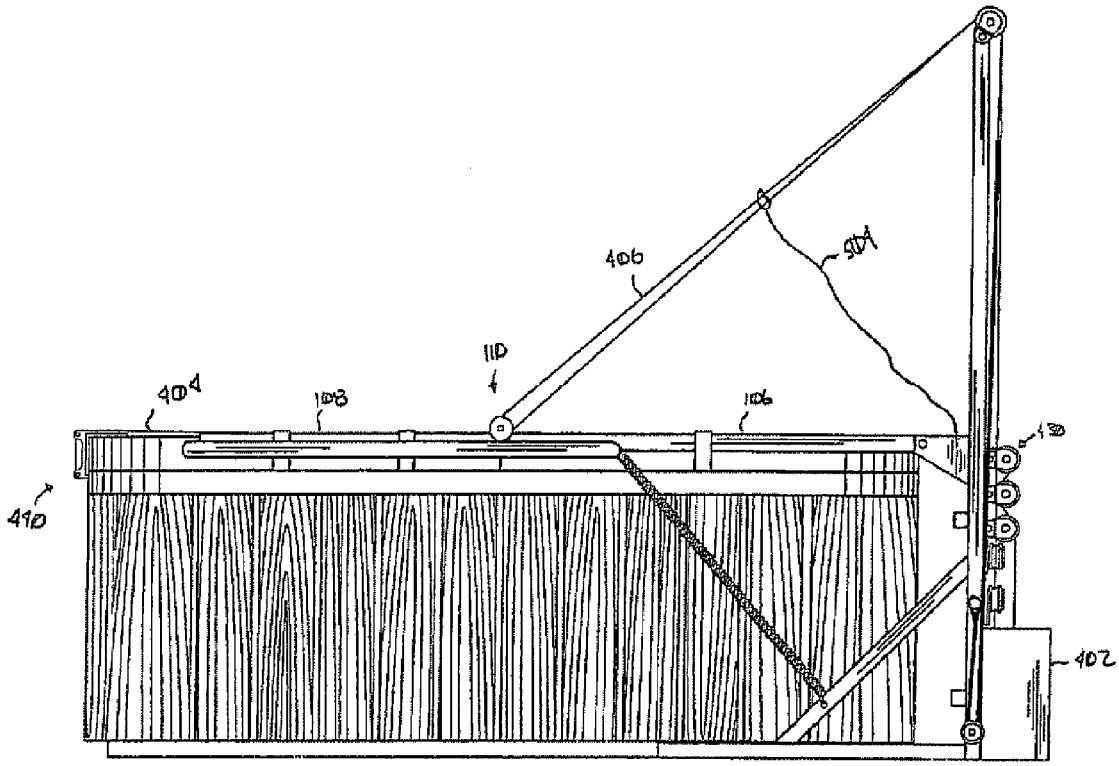
Figure 10:
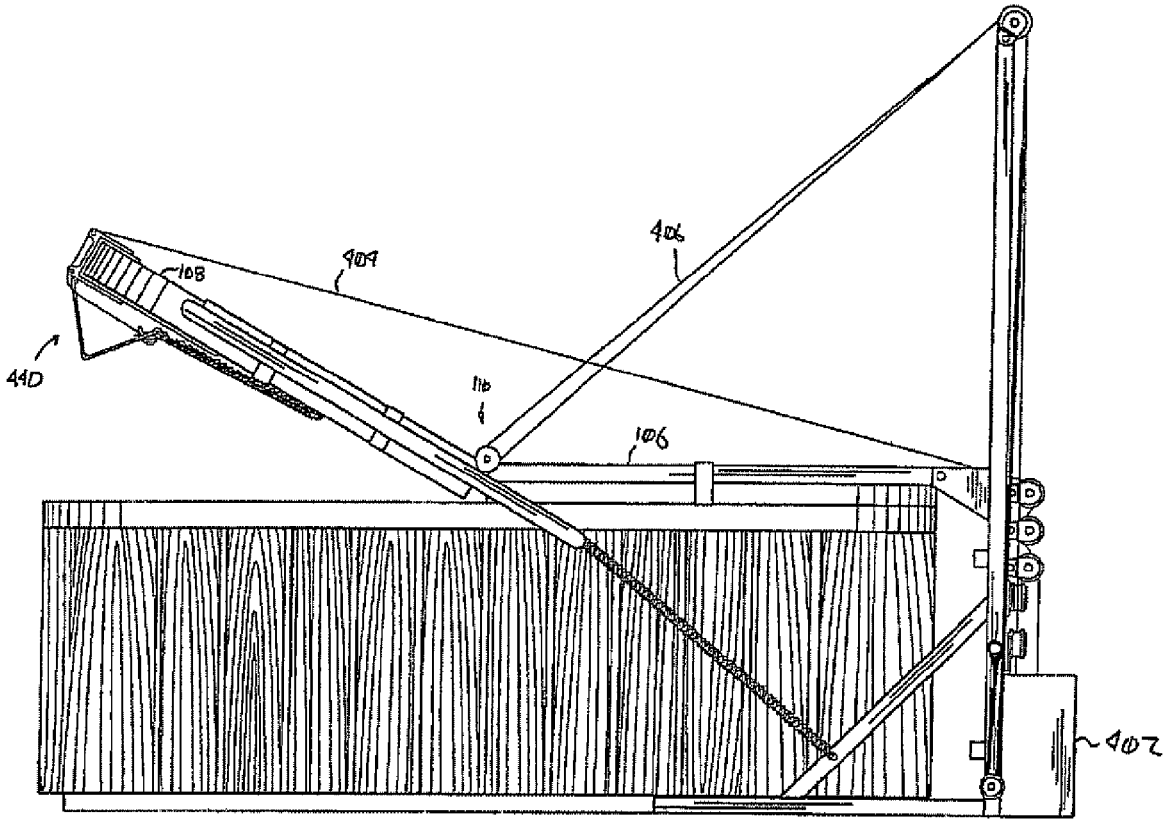
Figure 11:
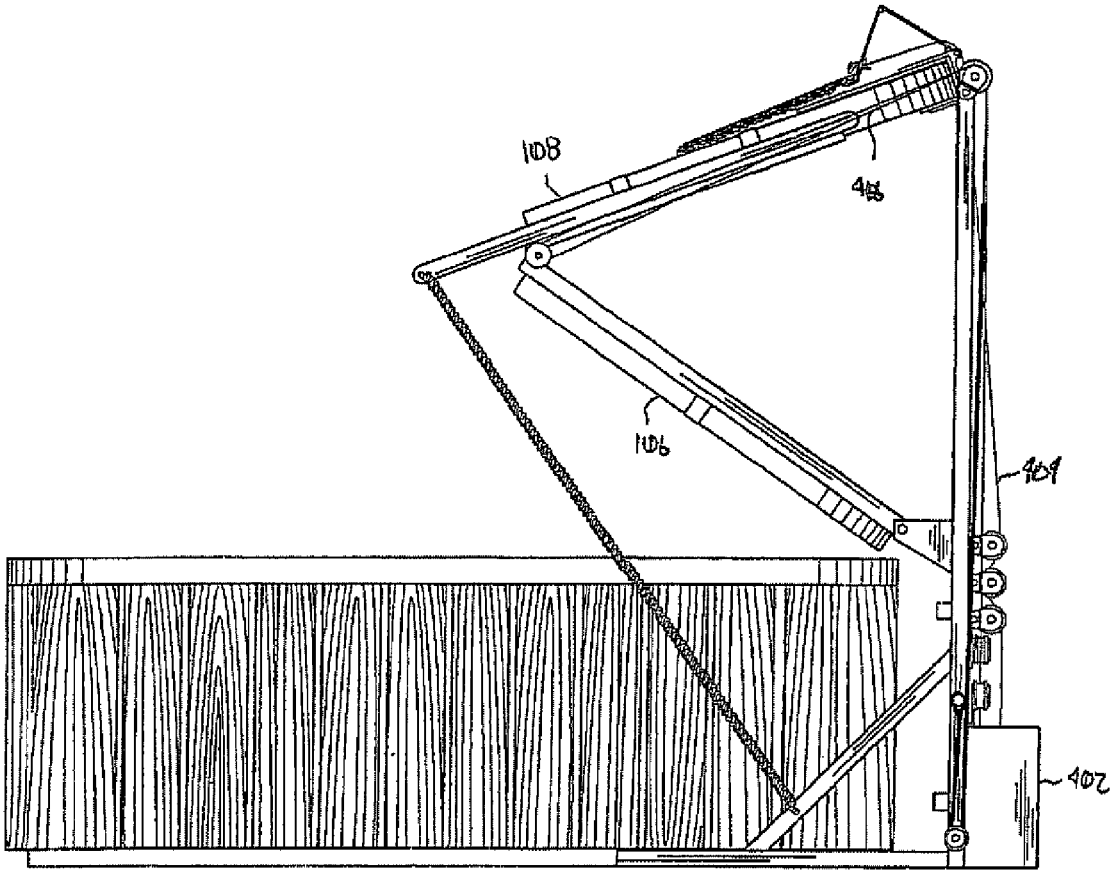
Figure 12:
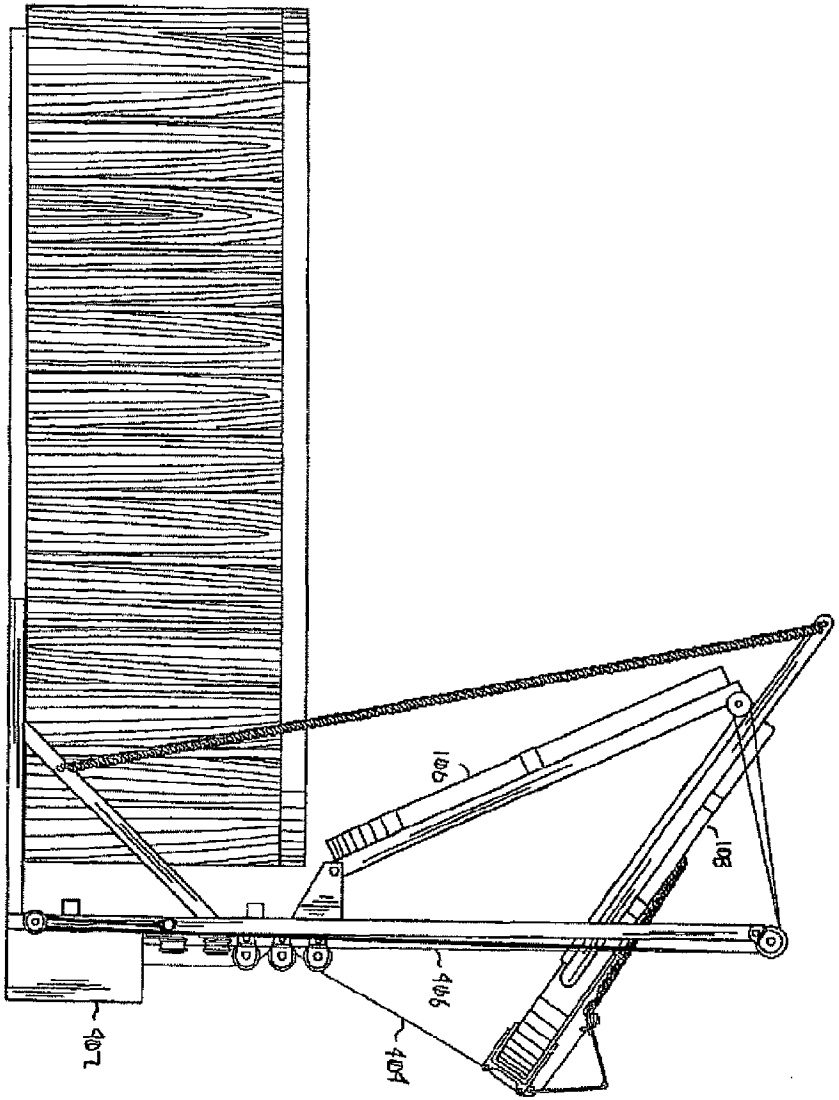
Figure 13:
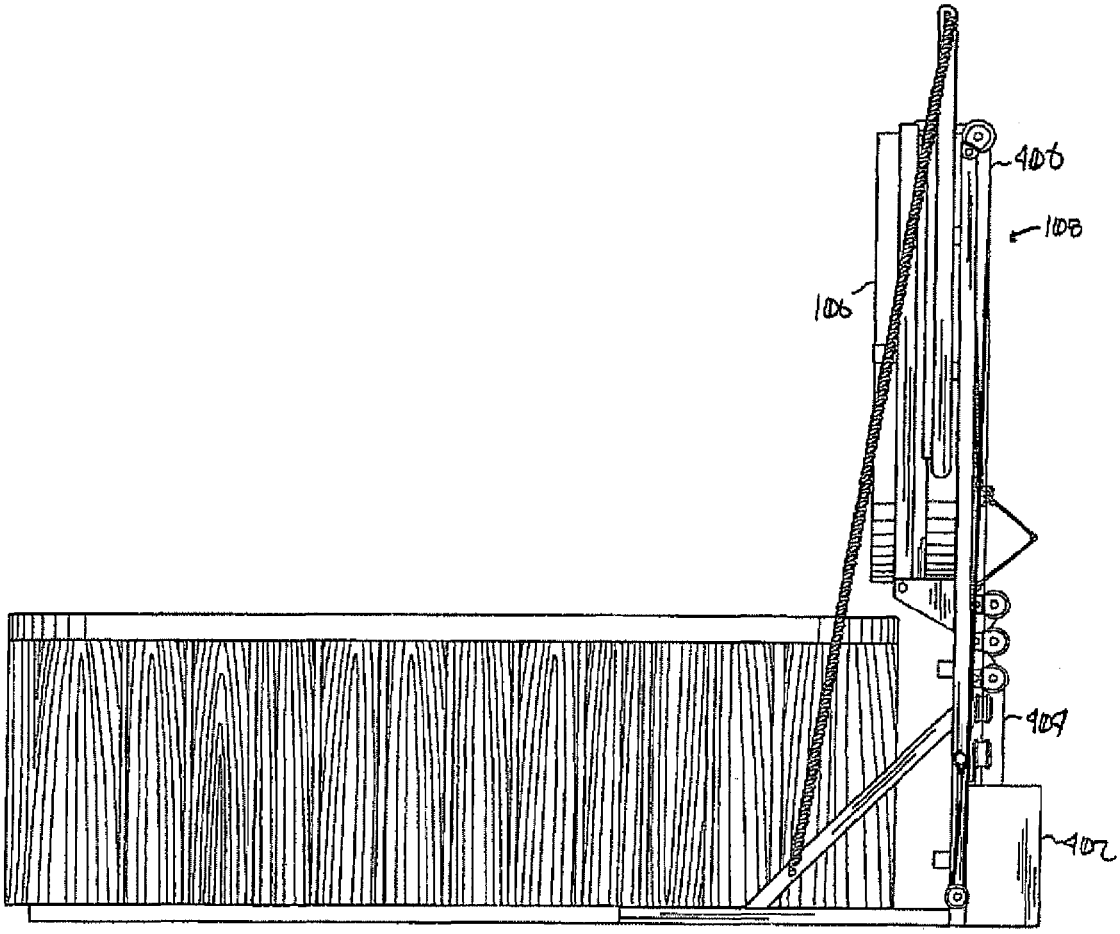

FIGS. 9-13 show a sequence for using the spa cover lifter 200 to transition the spa cover 104 between a closed position, for example, as shown in FIG. 9, and an open position, for example, as shown in FIG. 13. To begin the transition, the drive mechanism 402 may initially apply a first lifting force to the section 108 of the spa cover 104 by retracting cable 404. The first lifting force may cause section 108 of the spa cover 104 to fold towards the section 106 along hinge interface 110. Relative to the section 106, the section 108 may be pivoted through about 180 degrees. The first lifting force may be maintained, e.g., the cable 404 may be continually retracted, until the section 108 of the spa cover 104 is substantially folded against the section 106. It will be appreciated that folding the spa cover 104 may cause the means for storing and releasing a torque, for example, lever arm 350 and spring 352 and/or torsion spring 354, to store a torque resulting from the folding.

In various embodiments, the interface assembly 440 may help guide the first lifting force in a vertical direction and/or break any seal that may have formed between the spa cover 104 and the spa 100. For example, as the cable 404 is retracted, the interface device 444 may lift the section 108 of the spa cover 104 from the spa tub 102. This may break any seal existing between the section 108 and the spa tub 102. Also, the upward motion of the section 108 may change the angle between the section 108 and the cable 404, causing the direction of the force exerted by the cable 404 to transition towards a more vertical direction, further lifting the section 108.

The drive mechanism 402 may also provide a second lifting force by retracting one or more of the cables 406, 408. In various embodiments, the cables 406, 408 may be retracted simultaneously. The second lifting force may cause the spa cover 104, e.g., through support members 320, 322, 324, 326, to rotate off of the spa tub 102 at hinges 340, 342. The second lifting force may be maintained until the spa cover 104 is pivoted off the spa 100 to a position that generally allows bathing in the spa 100, e.g., at least about 90 degrees relative to the spa tub 102. It will be appreciated that in embodiments where one or more torsion springs 355, 357 or other means for storing and releasing a torque is included at one or both of hinges 340, 342, rotating the spa cover 104 of the spa tub 102 may store a torque in the torsion springs 355, 357 or other means for storing and releasing a torque.

Transitioning the spa cover 104 from a closed position to an open position may require pivoting the section 108 through a greater distance and angle than the section 106. Accordingly, transitioning from a closed position to an open position may require the drive mechanism 402 to retract a length of the cable 404 that is greater than the retracted length of the cables 406, 408. This differential retraction may be accomplished in any suitable manner.

For example, in various embodiments, the cable 404 and the cables 406, 408 may be retracted simultaneously and at substantially the same rate, e.g., the spools 422, 424, 426 may be of substantially the same diameter. The application of tension in the cables 406, 408, however, and thus the application of the second lifting force, may be delayed until the section 108 of the spa cover 104 has pivoted through a predetermined distance and/or angle. For example, when the cables 406, 408 are initially retracted, they may expand, eliminating or significantly reducing any force exerted on the interfaces 332, 334 or the spa cover 104. The cables 406, 408 may expand, for example, in their respective elastic sections 410, 412.

When the section 108 of the spa cover 104 has pivoted through the predetermined distance and/or angle, the expansion of the cables 406, 408 may be arrested, causing the second lifting force to be applied. In various embodiments, stops 414, 416 may be strategically placed on the cables 406, 408. As the cables 406, 408 expand, the stops 414, 416 may reach the post pulleys 474, 484, for example, after the spa cover 104 has pivoted through the predetermined distance and/or angle. Interaction between the stops 414, 416 and the post pulleys 474, 484 may prevent further expansion of the cables 406, 408, causing the second lifting force to be applied. It will be appreciated that the stops 414 may be mounted anywhere on the cables 406, 408 that allows them to contact post pulleys 414, 416, or any other pulleys or structure, after the spa cover 104 has pivoted through the predetermined distance or angle. For example, the stops 414, 416 may be mounted between the post pulleys 474, 484 and pulleys 476, 486. In other various embodiments, the stops 414, 416 may be mounted between the post pulleys 474, 484 and the interfaces 332, 334.

The expansion of the cables 406, 408 may also be accomplished by strategically choosing the length and material of the cables 406, 408. For example, the material and length of the cables 406, 408 including elastic portions 410, 412, may be chosen such that the cables 406, 408 reach their maximum length when the first section 108 has been pivoted through the predetermined distance and/or angle.

The differential retraction of the cables 404, 406, 408 may also be accomplished, for example, by retracting the cable 404 and the cables 406, 408 for different amounts of time and/or at different rates. In various embodiments, for example, the cable 404 and the cables 406, 408 may be retracted by separate drive mechanisms (not shown). This may allow the cable 404 and the cables 406, 408 to be retracted at different times and rates to accommodate the lifting of the spa cover 104.

Also, in various embodiments, the cable 404 and the cables 406, 408 may be retracted simultaneously, albeit at different rates. For example, the spool 422 corresponding to the cable 404 may have a larger diameter than the spools 424, 426 corresponding to the cables 406, 408. This may cause the cable 404 to be retracted at a greater rate than the cables 406, 408, even though the driveshaft 420 may rotate the spools 422, 424, 426 at the same rate. The difference in diameter between the spool 422 and the spools 424, 426 may be chosen such that both sections 106, 108 of the spa cover 104 reach an open position after the same number of rotations of the driveshaft 420.

According to various embodiments, the spa cover lifter 200 may also transition the spa cover 104 from an open position to a closed position. For example, the spa cover lifter 200 may perform the sequence shown in FIGS. 9-13 in reverse. Instead of retracting cables 404, 406, 408, the drive mechanism may extend the cables. It will be appreciated that gravity may cause the spa cover 104 to rotate toward the spa tub 102 as the cables 404, 406, 408 are extended. In embodiments where a torsion spring (not shown), or other means for storing and releasing a torque, are included at hinge 340 and/or hinge 342, releasing the cables 404, 406, 408 may cause a torque stored in the torsion spring (not shown) or other means to be released, further causing the spa cover 104 to rotate towards the spa tub 102.

In addition, as the cable 404 is extended the torque stored by the means for storing and releasing a torque may be released, causing the section 108 of the spa cover 104 to unfold away from the section 106. This may initially move the center of mass of the spa cover 104 toward the center of the spa tub 102, enhancing the effects of gravity. As the spa cover 104 nears a closed position, the release of the torque may cause the sections 106, 108 to completely unfold, thus completing the closing transition.

The spa cover lifter 200 may include various safety features. For example, the spa cover lifter 200 may include a safety sensor 502 for sensing motion in the water of the spa 100 as shown in FIG. 3. The safety sensor 502 may be wired to the drive mechanism 402 and may be configured to prevent the drive mechanism 402 from placing the spa cover 104 in a closed position while motion is detected in the spa tub 102. This may prevent the spa cover 104 from being closed while a person is still using the spa 100. The safety sensor 502 may be mounted to an interior wall of the spa tub 100 as shown in FIG. 3, or in various embodiments, may be a free-floating sensor. The spa cover lifter 200 may also include a safety activation button (not shown). The safety activation button may require a user of the spa cover lifter 200 to hold the activation button down for a given length of time, e.g., five seconds, before this spa cover lifter 200 begins to open or close the spa cover 104. This may prevent an inadvertent activation of the spa cover lifter 200.

In various embodiments, the spa lifter 200 may also include devices for dressing the various cables 404, 406, 408 while the spa 100 and spa lifter 200 are not in use. For example, maintaining the cables 406, 408 in a substantially straight line between the post pulleys 474, 484 and the pole 330 may create a hazard, as people may trip over the cables 406, 408, or become entangled. Therefore, in various embodiments, an elastic cord 504 may be stretched between one or more components of the frame structure 300 and cables 406, for example as shown in FIG. 9.

The elastic cord 504 may exert a force on the cable 406 tending to pull it towards the frame structure 300. The tension on the elastic cord 504 may be chosen so that the force exerted on the cable 406 has a minimal effect on the operation of the spa lifter 200. When the spa cover 104 is in a closed position, the drive mechanism 402 may be configured to extend the cable 406 slightly, allowing the tension on the elastic cord 504 to pull the cable 406 toward the frame structure 300. Accordingly, the cable 406 may be stored against the frame structure 300. It will be appreciated that a similar elastic cord (not shown) may be installed between the cable 408 and the frame structure 300.

FIGS. 14-22 show various embodiments of a spa cover lifter 200 including retractable post assemblies 360, 370 according to various embodiments. FIG. 14 shows a diagram of various components of the spa cover lifter 200 including support members 320, 322, 324, 326, drive system 400 and retractable post assemblies 360, 370. It will be appreciated that the spa cover lifter 200 may include additional components not shown in FIG. 14 including, for example, a stand 310 and brace 312 as shown in FIG. 2.

Figure 16:
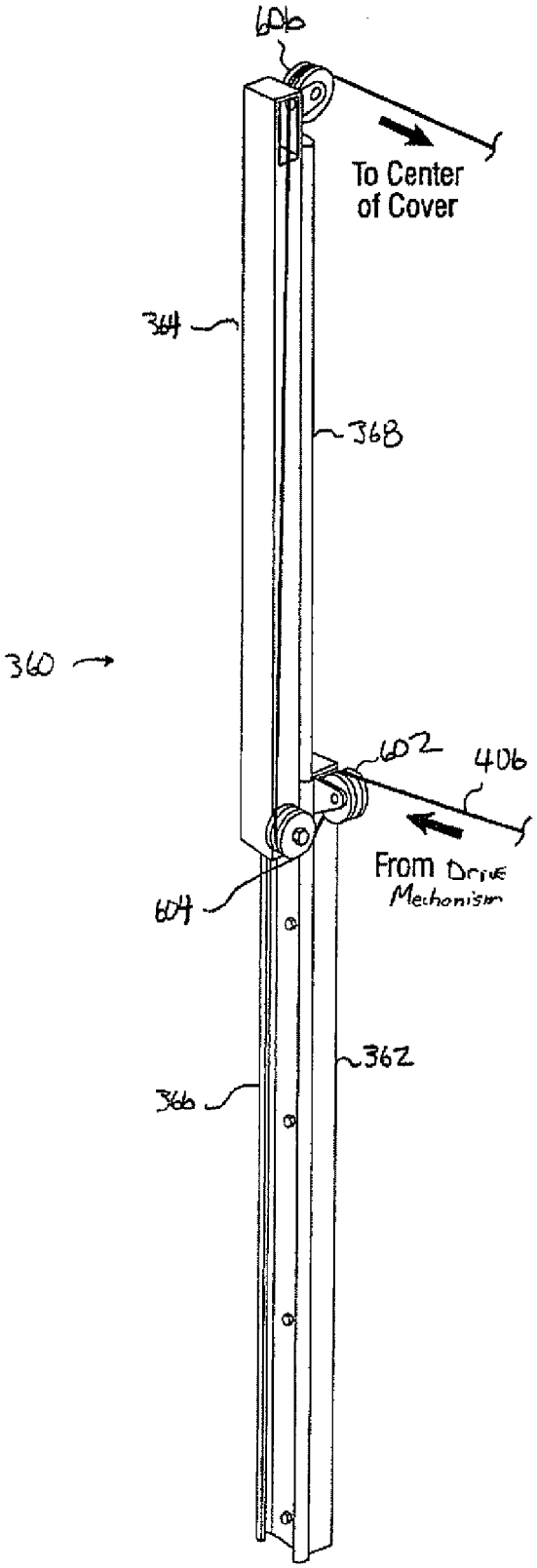
FIGS. 15-16 illustrate a retractable post assembly for inclusion in a spa cover lifter according to various embodiments with the retractable post assembly in a retracted position.
Figure 15:
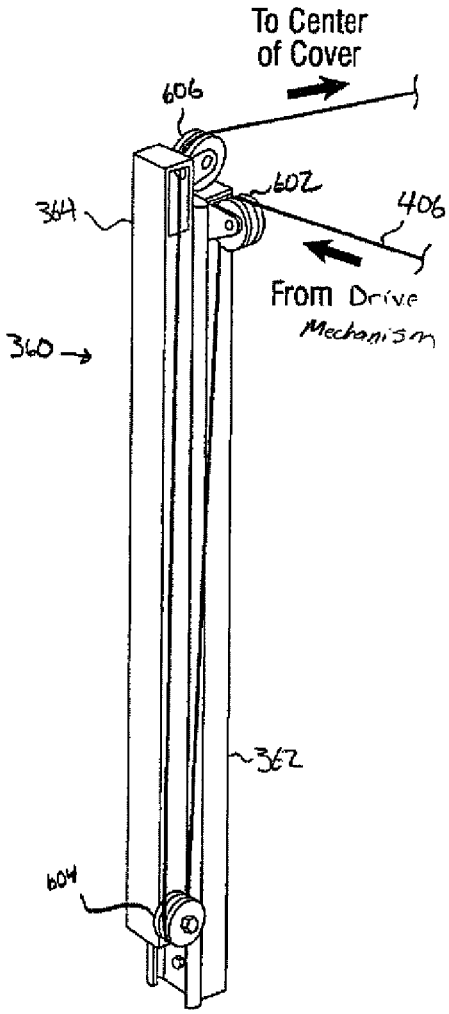

Referring now to FIG. 15, the post assembly 360 is shown in a retracted position. The post assembly 360 may include a bottom member 362 and a top member 364. The top member 364 may be extendable relative to the bottom member 362, allowing the post assembly 360 to transition, for example, from the retracted position shown in FIG. 15 to an extended position, as shown in FIG. 16. In various embodiments, the bottom and top members 362, 364 may be slidably coupled relative to each other. For example, as shown in FIGS. 15 and 16, the bottom member 362 includes a track 366, while the top member 364 includes a slide 368. The slide may fit within the track 366, allowing the top member 364 to extend relative to bottom member 362. Pulleys 602, 604, 606 may be fastened to the top and bottom members 363, 364 to route cable 406, for example, as described below.

Figure 17:
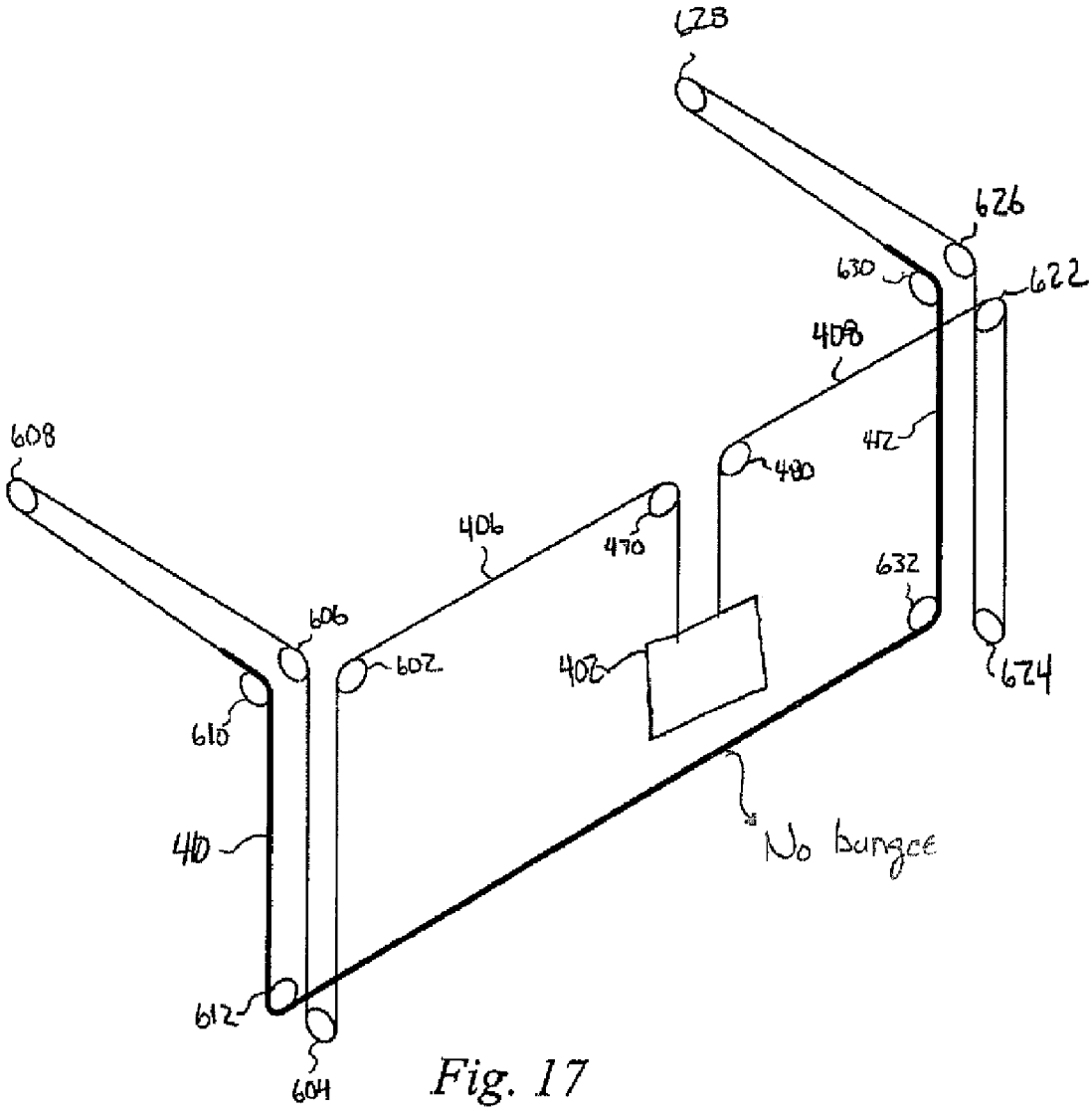
FIG. 17 illustrates a schematic showing the routing of cables in a spa cover lifter according to various embodiments.

FIG. 17 shows the routing of the cables 406, 408 through various pulleys of the spa cover lifter 200 according to various embodiments. It will be appreciated that the relative positions of the cables 406, 408 and pulleys may change as the spa cover lifter 200 operates. As shown in FIG. 17, cable 406 extends from the drive mechanism 402 around drive pulley 470 to pulley 602, which may be coupled to the bottom member 362 of post 360 as shown in FIGS. 14-16. Pulley 602 may route the cable 406 to lift pulley 604 coupled to top member 364. The cable 406 may then extend from pulley 604, through pulley 606, to pulley 608. As shown in FIG. 14, pulley 608 may be located at or near the interface 331. From the interface 332, pulley 608 routes the cable 406 to pulleys 610 and 612, which may be coupled to bottom member 362.

From the pulley 612, the cable 406 may be routed to a termination point 478 as shown in FIG. 14, or in various embodiments, may be connected with cable 408 as shown in FIG. 17. Also, the cable 406 may include an elastic section 410, allowing the cable 406 to lengthen in response to tension.

Cable 408 may extend from the drive mechanism 402 in a manner similar to that of 406. For example, the cable 408 may be routed around drive pulley 480 to pulleys 622, 624, 626, 628, 630, and 632 respectively. Cable 408 also may be terminated at a termination point (not shown), or may be connected with cable 406 as shown in FIG. 17. According to various embodiments, a connection between cables 406 and 408 may be routed through one of cross members 308. Like cable 406, cable 408 may include an elastic section 412 allowing it to lengthen in response to tension.

Figure 18:
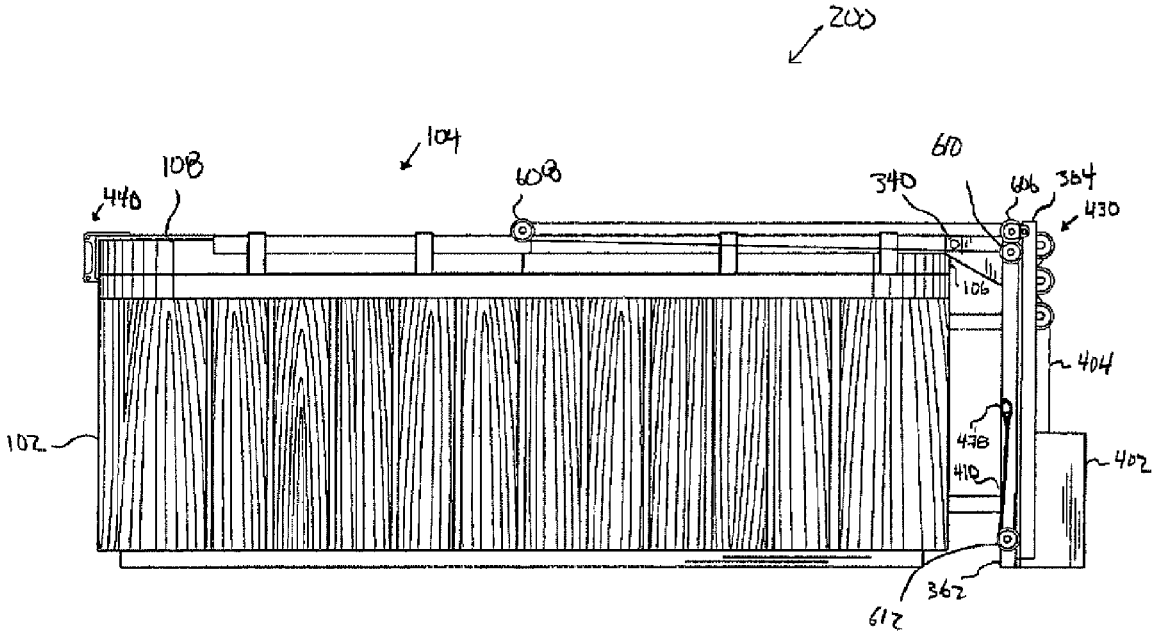
FIGS. 18-22 illustrate portions of a spa cover lifter installed on a spa according to various embodiments.
Figure 21:
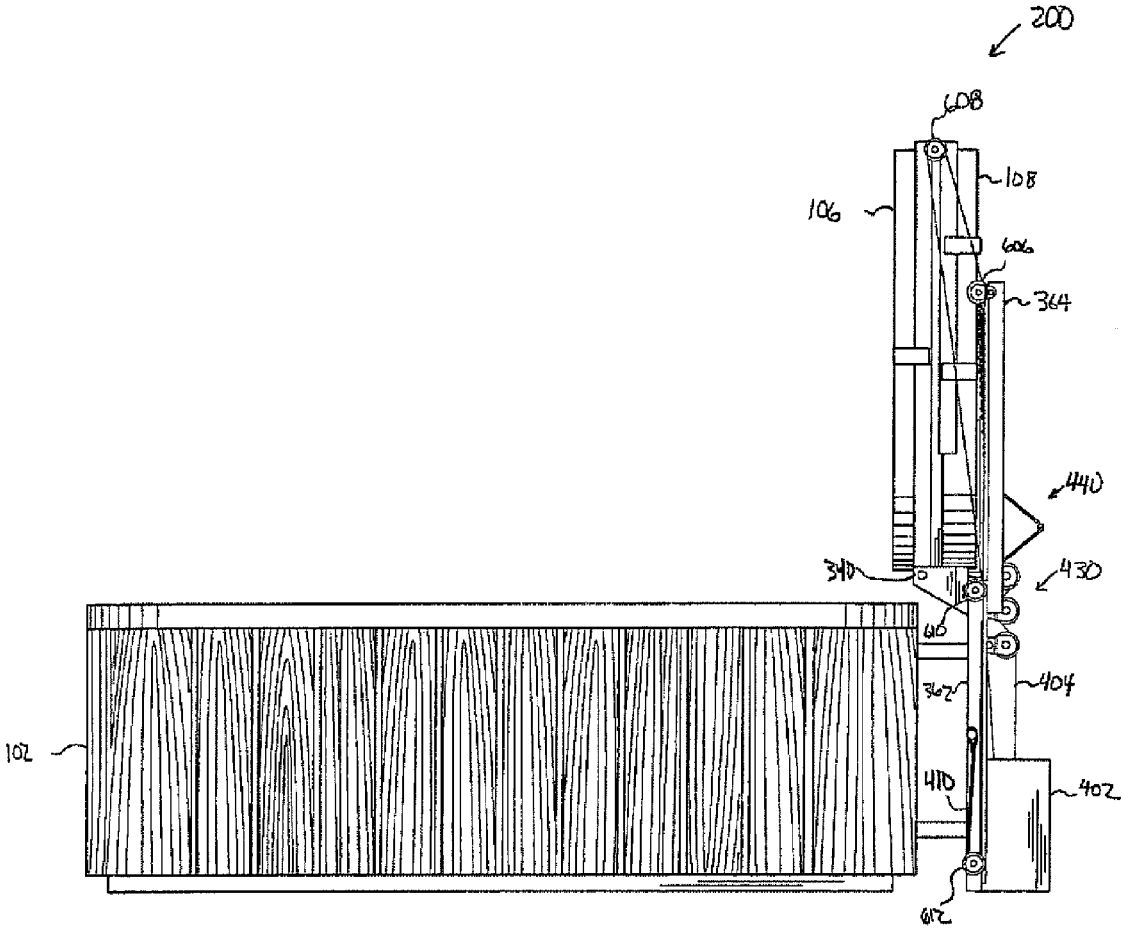

FIGS. 18-21 show a sequence for using embodiments of the spa cover lifter 200 having retractable post assemblies 360, 370 to transition the spa cover 104 between a closed position, as shown in FIG. 18, and an open position, as shown in FIG. 21. Referring the FIG. 18, the spa cover 104 is shown in a closed position. The post assemblies 360, 370 are in a retracted position, and may be roughly flush with the top of the spa 100 and spa cover 104 as shown.

As described above, transitioning the spa cover from a closed position to an open position may require retracting a greater length of cable 404 than of cables 406 and 408. This may be accomplished according to any suitable method or combination of methods. For example, the cable 404 and the cables 406 and 408 may be retracted over different time intervals, for example, by separate drive mechanisms. Also, the cables 404, 406, and 408 may be wound on different sized spools 422, 424, 426 of the same drive mechanism 402 as shown in FIG. 6 above. Various other embodiments may utilize elastic sections 410 and 412, that allow the cables 406, 408 to initially lengthen as shown in FIGS. 18-21 and described below.

Figure 19:
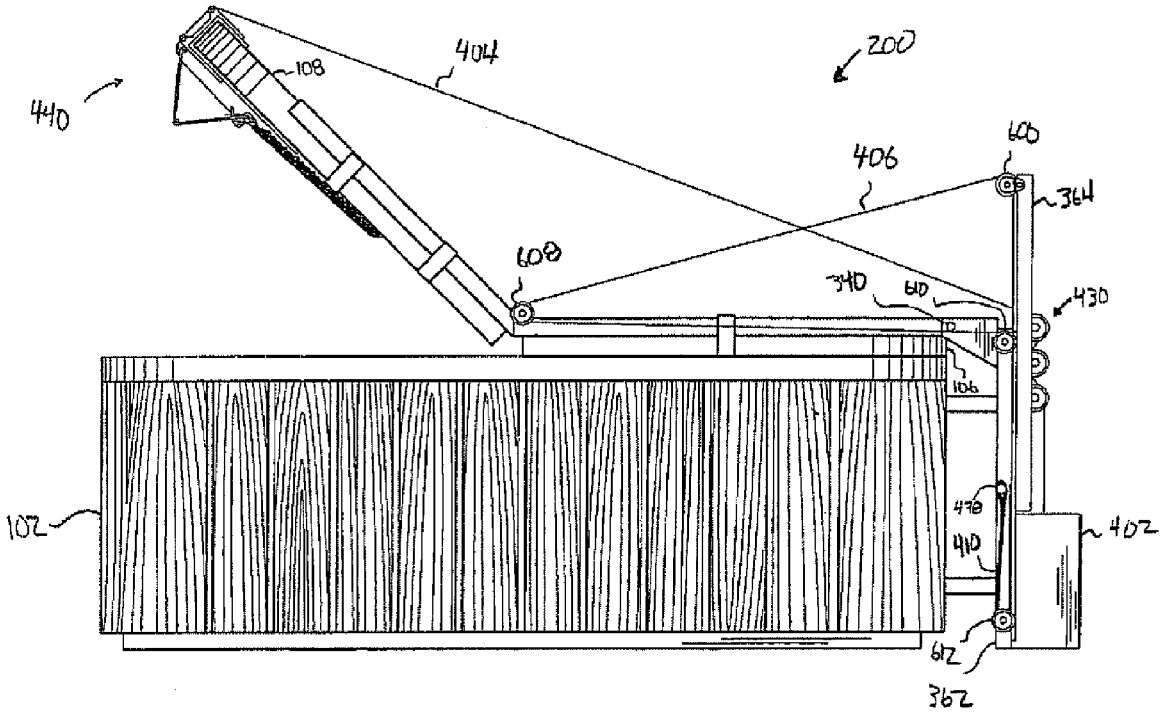
Figure 20:
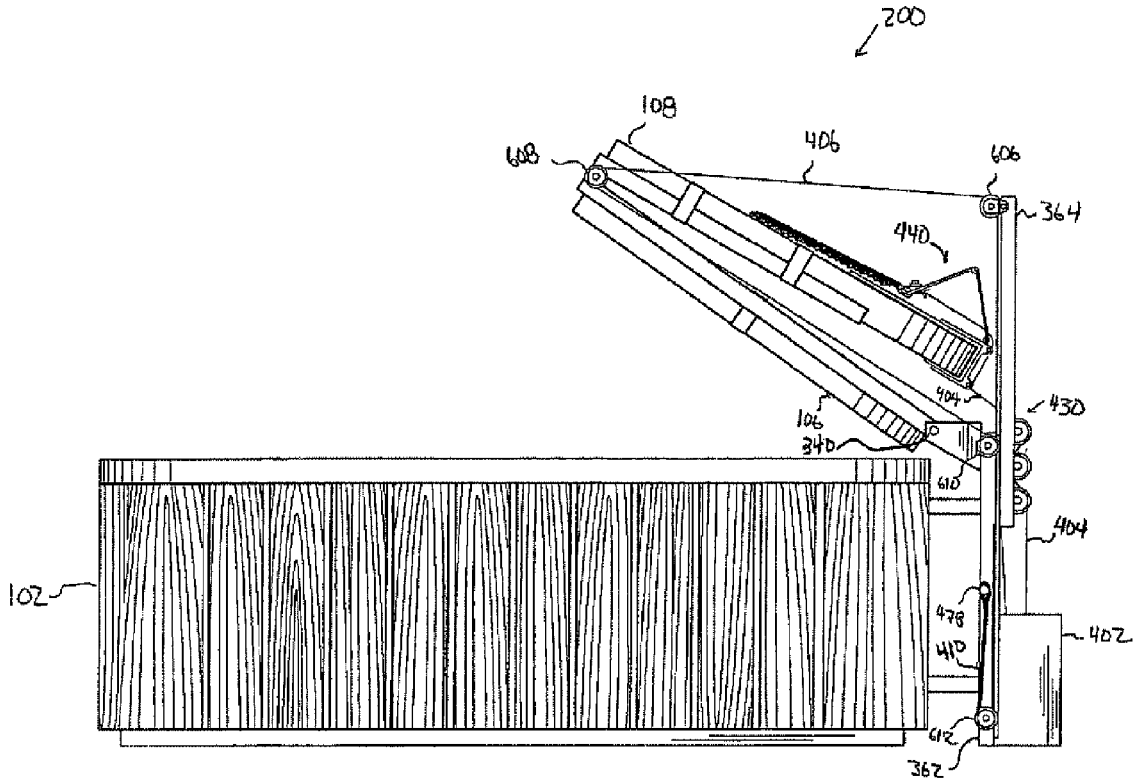

According to various embodiments, the drive mechanism 402 may initially begin to retract cable 404 and cables 406, 408. The retraction of cable 404 exerts a lifting force on spa cover section 108, causing it to fold toward the spa cover section 106 at hinge interface 110, as shown in FIG. 19. Initial lifting of the spa cover section 108 may be facilitated by the interface assembly 440 as described above. It will be appreciated that folding of the spa cover 104 about the hinge interface 110 may store a torque about the hinge interface 110, for example, by loading torsion springs 359, 354, or spring 352 and lever arm 350.

The retraction of cables 406 and 408 initially causes the respective elastic sections 410 and 412 to stretch, increasing the length of the cables 406, 408. Continued retraction of the cables 406, 408 causes the lengthening to lessen or stop. For example, lengthening of the cables 406, 408 may slow and/or stop as the elastic sections 410, 412 approach a maximum length. Also, it will be appreciated that the cables 406 and 408 may include stops 414, 416 that arrest further lengthening of the cables 406, 408 at a pre-selected length, as described above with reference to FIG. 2.

As the lengthening lessens or stops, the cables 406, 408 begin to exert an upward force on post top members 364 and 374 via pulleys 604 and 624 respectively (shown in FIGS. 14-16). The upward force causes post top members 364 and 374 to extend relative to post bottom members 362, 372 as shown in FIGS. 16 and 19. As the post top members 364, 374 extend, the cables 406, 408 may exert a lifting force at pulleys 608 and 628, causing the spa cover 104 to rotate off of the spa 100 about hinges 340, 342. It will be appreciated that the lifting force at pulleys 608 and 628 and/or resulting rotation of the spa cover 104 at hinges 340, 342 may begin before the post top member 363, 372 reach the rally extended position shown in FIG. 20. Also, as described above, rotation of the spa cover 104 about hinges 340, 342 may store a torque, for example utilizing torsion springs 354. When the retraction of cables 404, 406 and 408 is completed, the spa cover 104 may be in the open position shown in FIG. 21.

It will be appreciated that the spa cover 104 may also be transitioned from the open position shown in FIG. 21 to the closed position shown in FIG. 18 by extending cables 404, 406 and 408. As the cable 404 is extended, torque stored about the hinge interface 110 during the lifting process is released, causing the spa cover section 108 to unfold relative to spa cover section 106. As cables 406, 408 are extended, torque stored about hinges 340 and 342 during the lifting process is released, causing the spa cover 104 to rotate toward the spa 100. As the spa cover 104 rotates toward the spa 100, the lifting force provided by the cables 404, 406 at pulleys 604, 624 may lessen, causing post top members 364, 374 to retract, for example, under the force of their own weight. Also, the elastic sections 410, 412 of the cables 404, 406 may retract, causing the cables 404, 406 to return to a shorter length.

Figure 22:
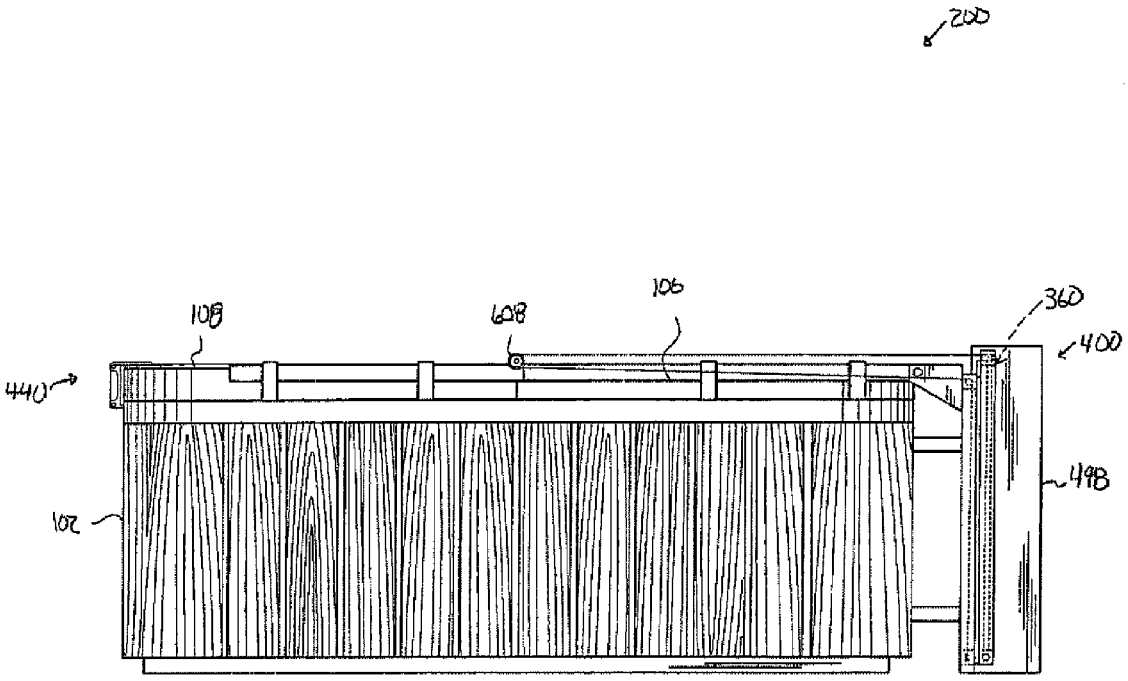

FIG. 22 shows the spa cover lifter 200 with a drive system enclosure 498. The drive system enclosure 498 may enclose the drive system 400, drive post 306 and associated pulleys 430 and other assemblies. In various embodiments, the drive assembly enclosure 498 may also enclose retractable post assemblies 460, 470 as shown. This may prevent dirt and other contaminants from interfering with the drive system 400. The enclosure 498 may also prevent users of the spa cover lifter 200 from becoming entangled in its moving parts.

According to various embodiments, torsion springs 354, 355, 357 may be configured to store and release different torques in opposite directions at different points of the cover removal and replacement process. For example, during lifting, as the spa cover section 108 begins to rotate off of the spa 102, torsion spring(s) 354 may initially release a first torque in a direction that assists the rotation of the section 108 about the hinge interface 110. After the section 108 rotates through a pre-determined angle (e.g., 20 degrees), torsion spring(s) 354 may stop assisting the rotation and begin to resist it. By resisting the rotation off of the spa 102, torsion spring(s) 354 may store a second torque in a direction opposite that of the first. The second torque may be useful in replacing the spa cover. For example, during cover replacement, when the section 108 initially begins to rotate back toward the spa 102, the second torque may be released, assisting the replacement of the section 108. The second torque may be released until the section 108 reaches the pre-determined angle relative to the spa 102. At this point, torsion spring(s) 354 may begin to resist the replacement of the section 108, thereby storing the first torque.

In various embodiments including torsion spring(s) 354 configured as described above, it may be necessary to fasten or otherwise secure the cover section 108 to the spa 102 when the spa cover 104 is in a closed position. This may prevent the spring(s) 354 from releasing the first torque and lifting the section 108 off of the spa 102 while the cover 102 is in place. The section 108 may be fastened to the spa 102 with any suitable kind of latch, strap, etc. Also, in various embodiments, when the torsion spring(s) 354 are configured as described above, it may not be necessary to include an interface assembly 440. This is because the lifting force provided by the first torque may be sufficient to break any seal formed between the section 108 and the spa 102.

According to various embodiments, torsion springs 355 and 357 may also be configured to store different torques in opposite directions about the hinges 340 and 342. For example, as the section 106 begins to rotate off of the spa 102 about hinges 340 and 342, spring(s) 355, 357 may release a first torque in a direction that aids the rotation. After a predetermined angle is reached relative to the spa 102, spring(s) 355, 357 may cease to aid the rotation and begin to resist it, thereby storing a second torque in a direction opposite the first torque. Again, the second torque may be useful during replacement of the spa cover 104. As the section 106 begins to rotate toward the spa 102, the second torque may be released, aiding the rotation of the section 106. When the section 106 reaches the predetermined angle relative to the spa, the spring (s) 355, 357 may begin to resist the rotation of the section 106, thereby storing the first torque.

Figure 23:
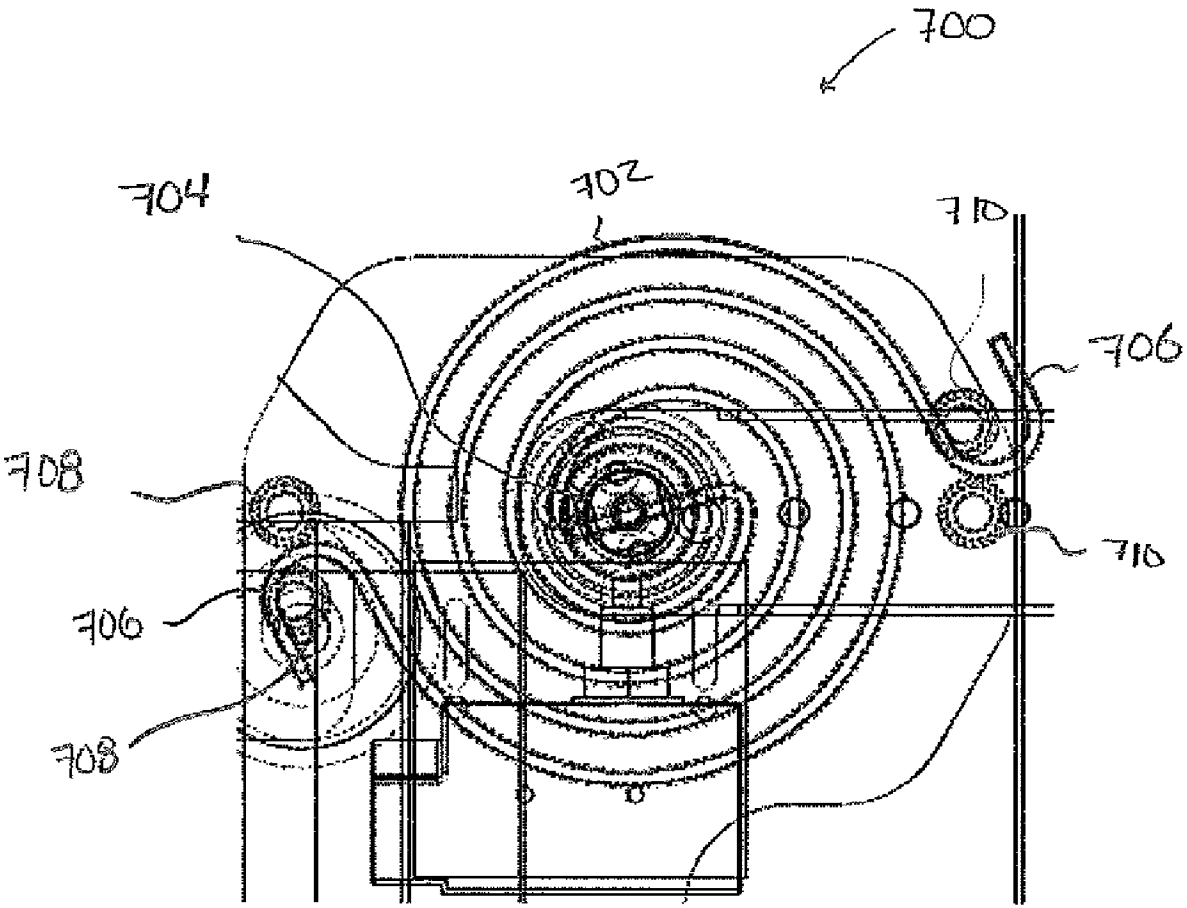
FIG. 23 illustrates an exemplary torsion spring according to various embodiments.

FIG. 23 shows a diagram of an exemplary torsion spring 700 that may store and release torques in opposite directions. According to various embodiments, the spring 700 may be used to embody any of the torsion springs described above (e.g., 354, 355, 357). The torsion spring 700 includes a coil 702 which may be made from a metal or any other suitable substance. The coil 702 may pass through a central pin 74. The central pin 704 may arrest the rotation of the coil 702, preventing it from freely rotating about the pin 704. At its ends, the coil 702 may include hook features 706 that engage posts 708, 710. The posts 708, 710 may be placed in contact with various other components (e.g., frame members 320, 324, hinges 240, 242, etc.). When the components in contact with the posts 708, 710 are moved, the spring 700 may store and release various torques, as described below.

As illustrated in FIG. 23, the spring 700 is in a resting position. The spring 700 may store a first torque in a first direction when the posts 708 are translated from the resting position about the central pin 704 in a counterclockwise direction toward the posts 710. This may tend to unwind the coil 702 about the pin 704, storing the first torque. (It will be appreciated that moving the posts 710 in a clockwise direction toward the posts 708 would have the same effect.) The spring 700 may store a torque in a second, opposite direction when the posts 708 are translated from the resting position toward the posts 710 in a clockwise direction (or if the posts 710 are moved toward the posts 708 in a counterclockwise direction). The various torques may be released by translating the posts 708 and 710 back toward the resting position. It will be appreciated that as the posts 708, 710 are translated through the resting position, the spring 700 may cease to release a torque and begin to store a torque in the opposite direction. The point at which the spring 700 transitions from releasing to storing (e.g., the resting position) a torque may be manipulated by manipulating the resting position. For example, the resting position may be manipulated by rotating the central pin 704. When the spring 700 is used as one or more of torsion springs 354, 355, 357, it may be manipulated to reach its resting position when the respective spa cover sections 108, 106 reach a predetermined angle relative to the spa 102 (e.g., 20 degrees).

Figure 24:
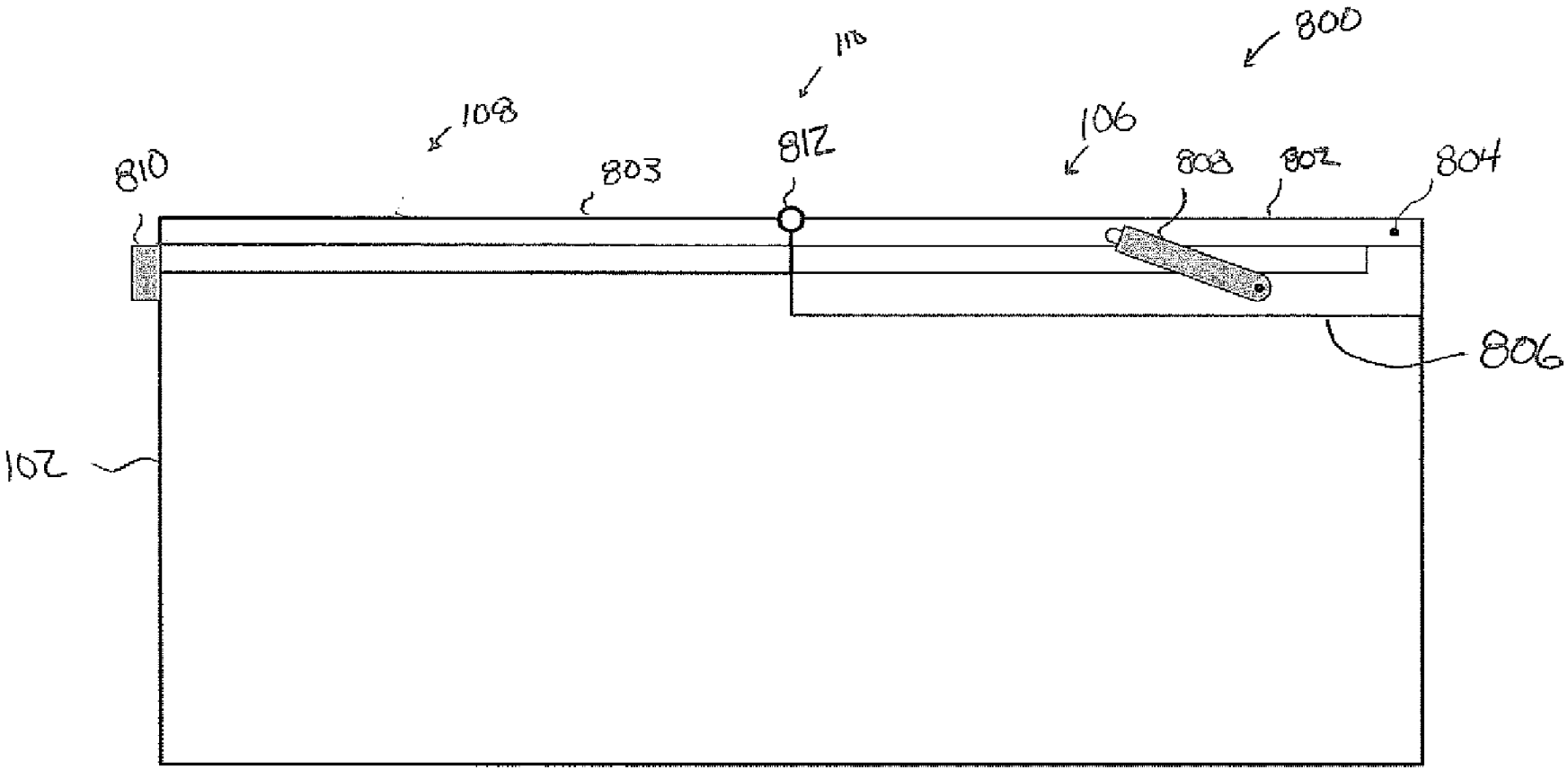
FIGS. 24-29 illustrate portions of a spa cover lifter installed on a spa according to various embodiments.
Figure 25:
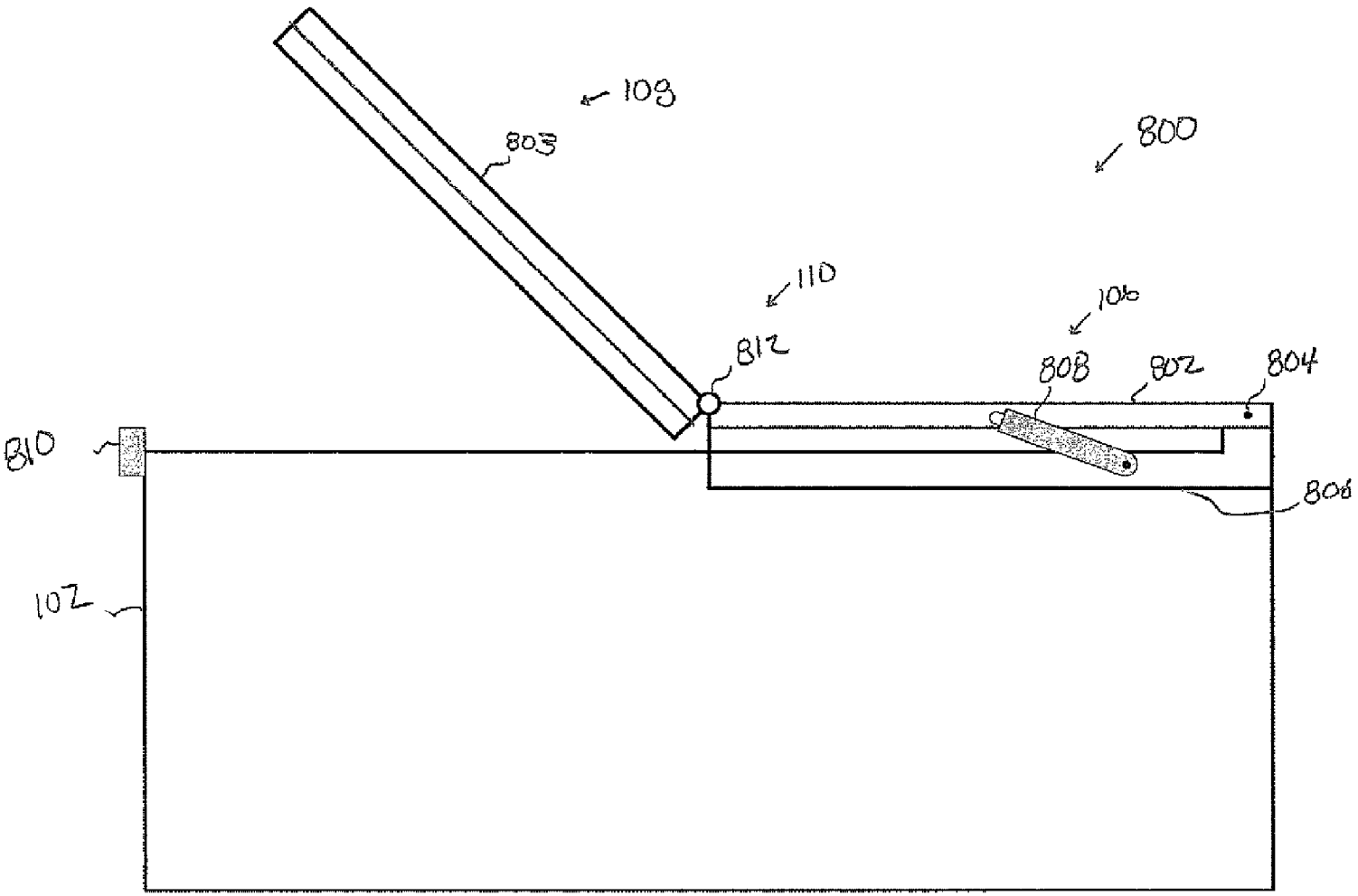
Figure 26:
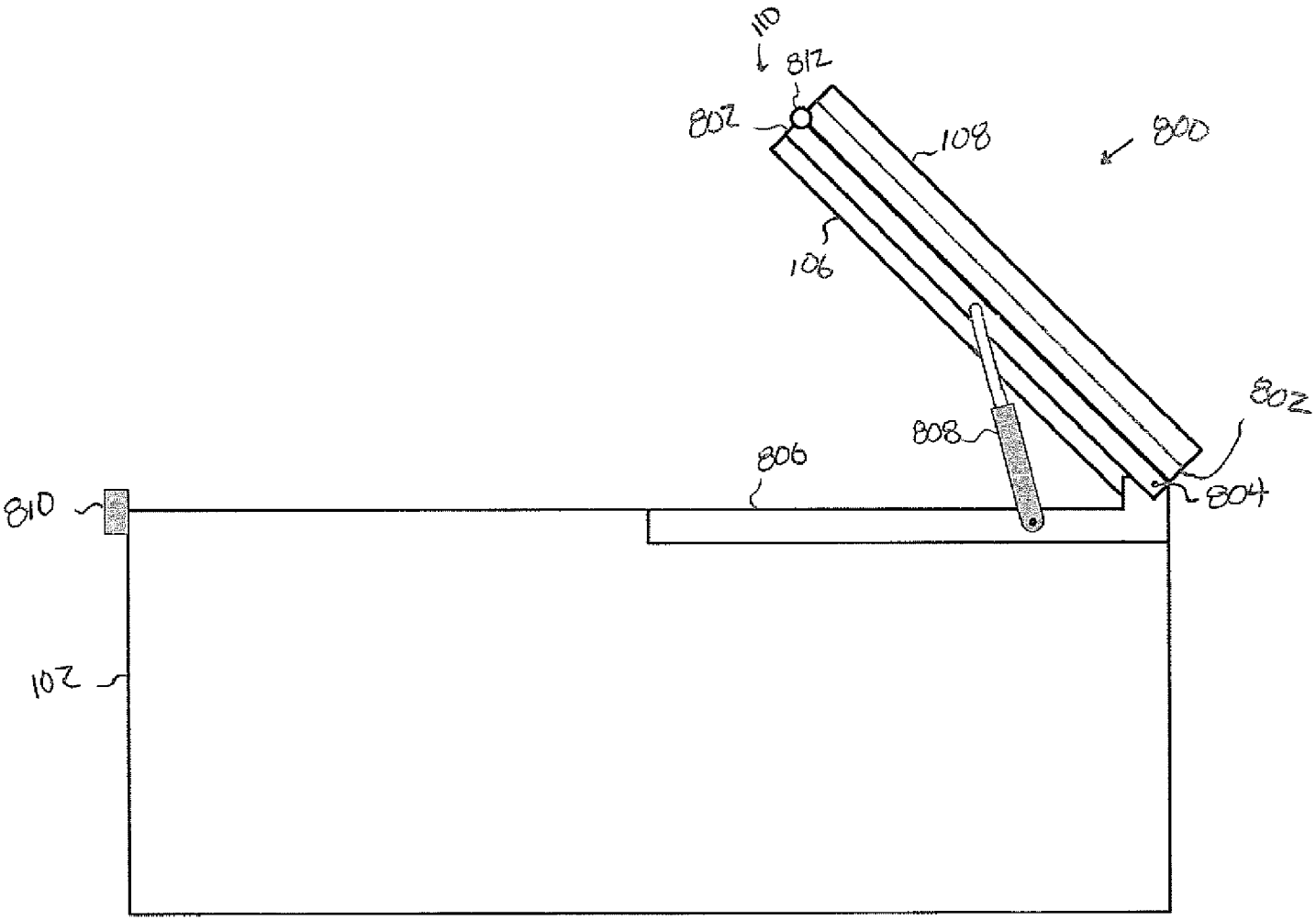

According to various embodiments, some of the concepts described herein may be utilized in a spa cover lift assist mechanism. FIGS. 24-26 show an example 800 of such a mechanism powered by a torsion spring 812 and a cylinder 808. The lift-assist 800 comprises frame members 803 and 802. Frame member 803 may be fastened to section 108 of the spa cover 104, while frame member 802 may be fastened to section 106. The two members 803 and 802 may be rotatably coupled to each other at about the hinge interface 110. Torsion spring 812 may be positioned at or near the interface between members 803 and 802.

The lift-assist 800 may also comprise a frame member 806 coupled to the spa 102. Frame member 802 may be rotatably coupled to the frame member 806 at hinge 804. A cylinder 808 may extend from frame member 806 to frame member 804 as shown. The cylinder 808 may be any kind of cylinder capable of providing an extending force including, for example, a gas shock, a hydraulic shock, etc. FIGS. 24-26 show side views of the lift-assist 800. It will be appreciated, however, that various embodiments may include similar, symmetric frame members, torsion springs and cylinders on the un-pictured side of the spa 102 as well.

In the position shown in FIG. 24, the torsion spring 812 may have a first stored torque tending to cause the cover section 108 to rotate off of the spa 102 about the hinge interface 110. A latch or strap 810 may oppose the first torque and allow the cover 104 to close. In use, a bather may release the latch and manually rotate the cover section 108 about the hinge interface 110, for example, as shown in FIG. 25. As the section 108 is rotated, the torsion spring 812 may release the first torque, thereby assisting the bather.

In various embodiments, the torsion spring 812 may be configured to store multiple torques in opposite directions, as described above. For example, the torsion spring 812 may release the first stored torque until the section 108 is rotated to a predetermined angle relative to the spa 102 (e.g. 90 degrees, 110 degrees, etc.). When the section 108 passes the predetermined angle, the torsion spring 812 may begin to store a second torque in a direction opposite to that of the first torque. When the cover section 108 is rotated back toward the spa 102 during closing, the second torque may be released, thus aiding the bather.

Referring again to a cover 104 opening procedure, when the cover section 108 is fully rotated onto the cover section 106, or sometimes while it is being so rotated, the bather may begin to rotate the section 106 off of the spa 102 about the hinge 804, as shown by FIG. 26. As the section 106 begins to rotate off of the spa 102, the cylinder 808 may begin to extend, exerting a lifting force on the cover 104 that tends to aid the bather. When the cover 104 reaches an acceptable position, it may be held in place by any suitable locking mechanism. For example, the cylinder 808 may include a lock preventing it from retracting. Also, a locking mechanism may be included at the hinge 804.

The lift-assist 800 is described with a torsion spring 812 to aid in the rotating of the section 108 off of the spa 102 and a cylinder 808 to aid in the rotating of the section 106 off of the spa 102. It will be appreciated, however, that a torsion spring 812 as described may be used to aid in rotating the section 108 in various other embodiments where different mechanisms (e.g., levers, pulleys, other torsion springs, etc.) are used to assist the lifting of the section 106. The various mechanisms may be coupled to the spa 102, or according to various embodiments, may be coupled to the ground or another surface proximate the spa.

Figure 27:
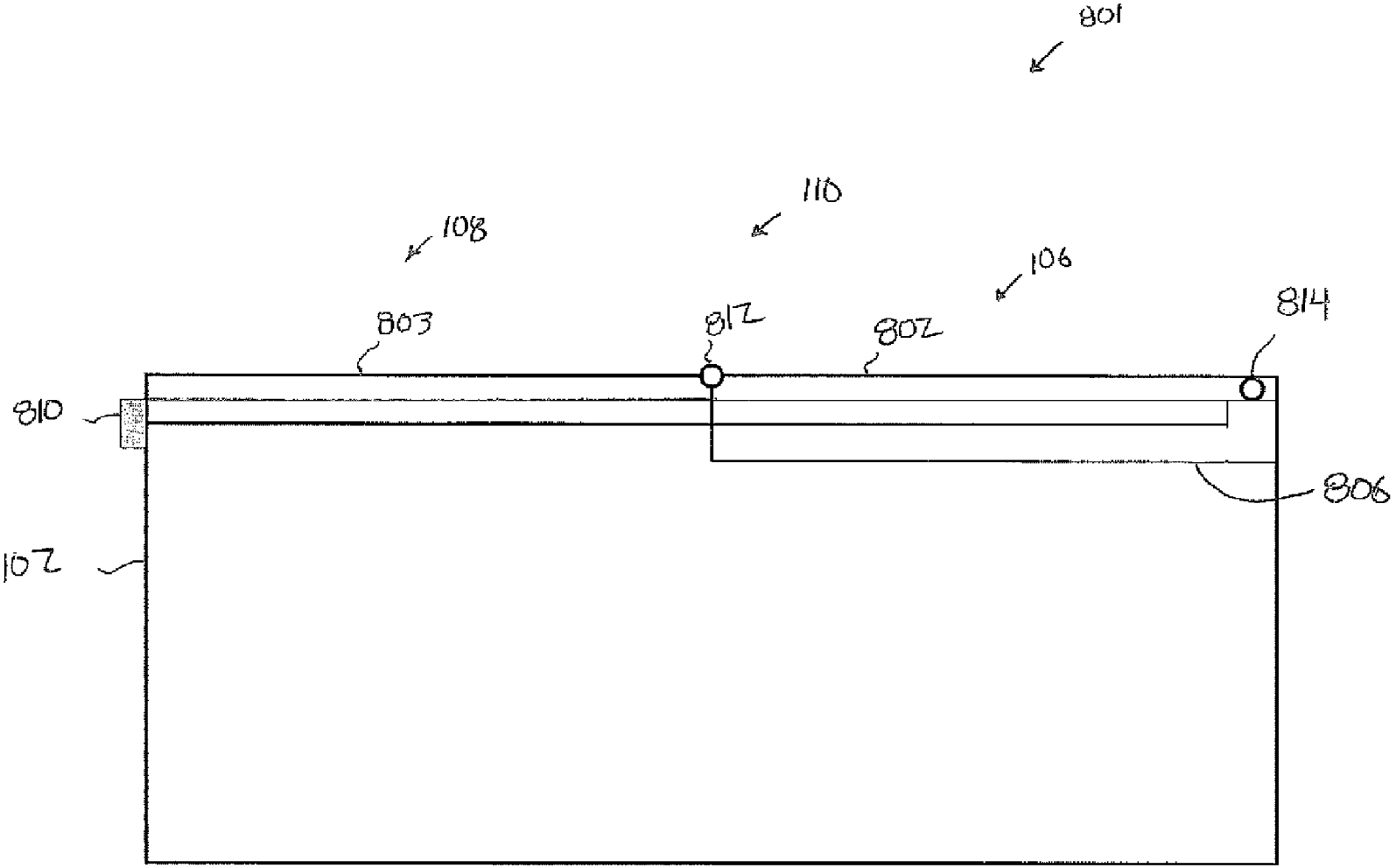
Figure 28:
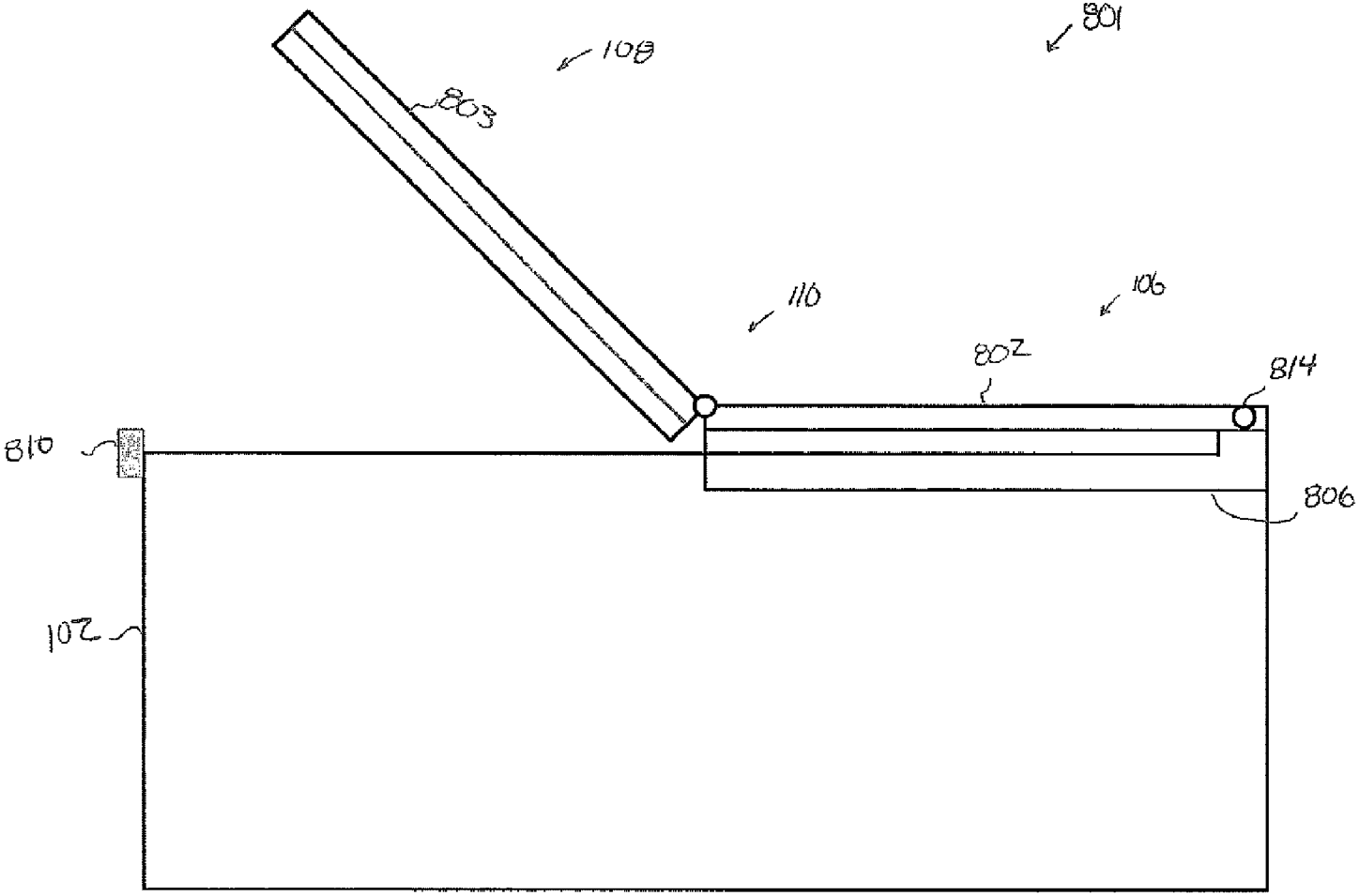
Figure 29:
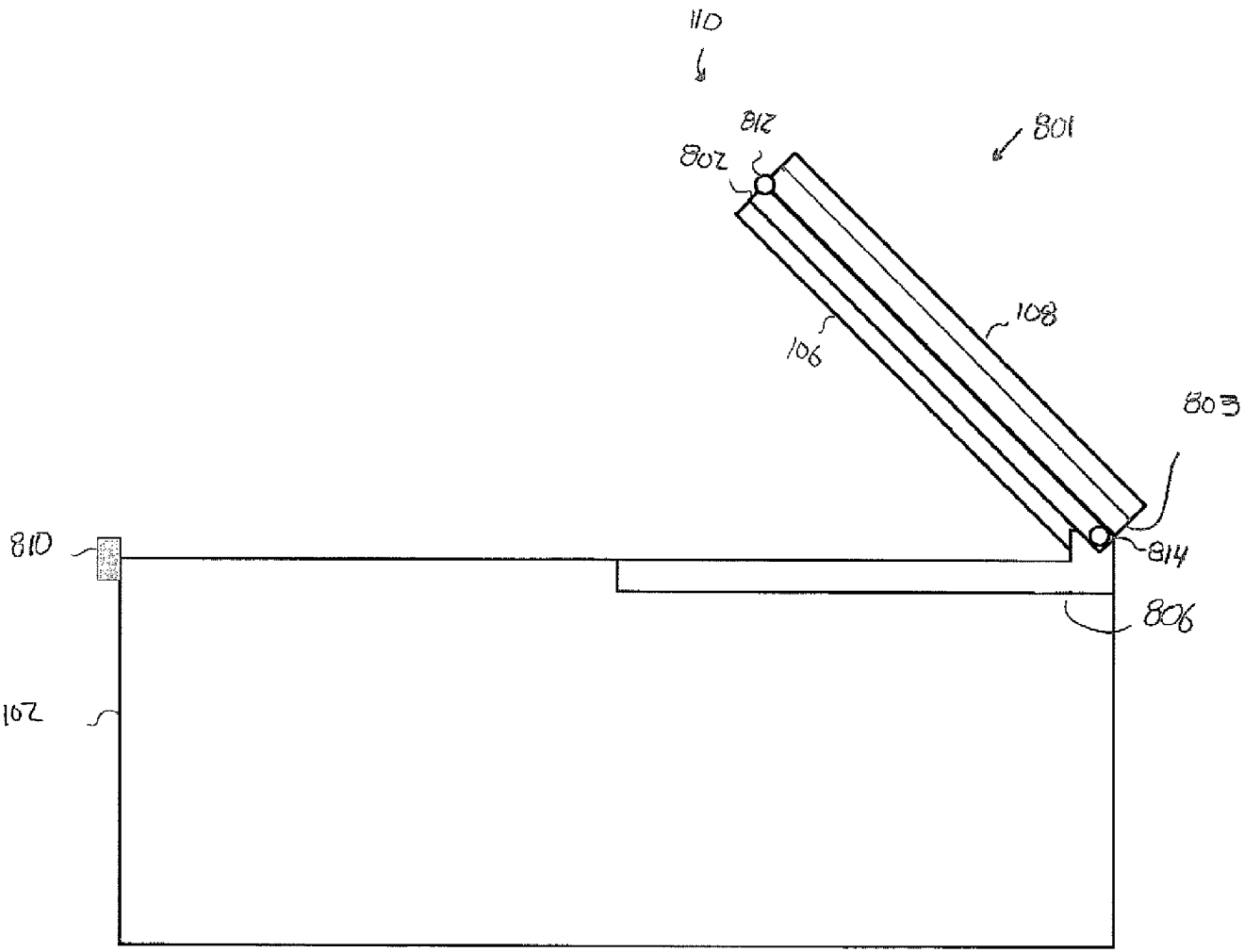

FIGS. 27-29 show an exemplary lift-assist 801 where cylinder 808 is replaced by a second torsion spring 814 positioned between the frame members 802 and 806. In use, the lift-assist 801 aids a bather in rotating the first cover section 803 off of the spa 102 by releasing a torque stored in torsion spring 812, for example, as described above with respect to lift-assist 800. When the bather begins to rotate the section 106 off of the spa 102, the torsion spring 814 may begin to release a second torque that aids in the rotation. When the cover 104 reaches an acceptable position for bathing it may be locked into place by any acceptable mechanism. For example, the torsion spring 814 may include a lock that arrests its further movement. Also, according to various embodiments, a strut may be locked between the frame members 806 and 802.

FIGS. 30-41 show a spa cover lifter 200, according to various embodiments, which does not include a central cable. Various embodiments may also omit the pole 330. In the spa cover lifter 200 as shown in FIGS. 30-41, cables 406 and 408 may be connected to points near the distal ends of frame members 324 and 326 respectively, rather than at the hinge interface 110, as described above. The cables 406, 408 may be positioned to both cause the section 106 to fold upon the section 108, and to cause the entire spa cover 104 to rotate off of the spa 102 about interfaces 340, 342. Accordingly, a central cable, such as cable 404, may not be necessary.

Figure 30:
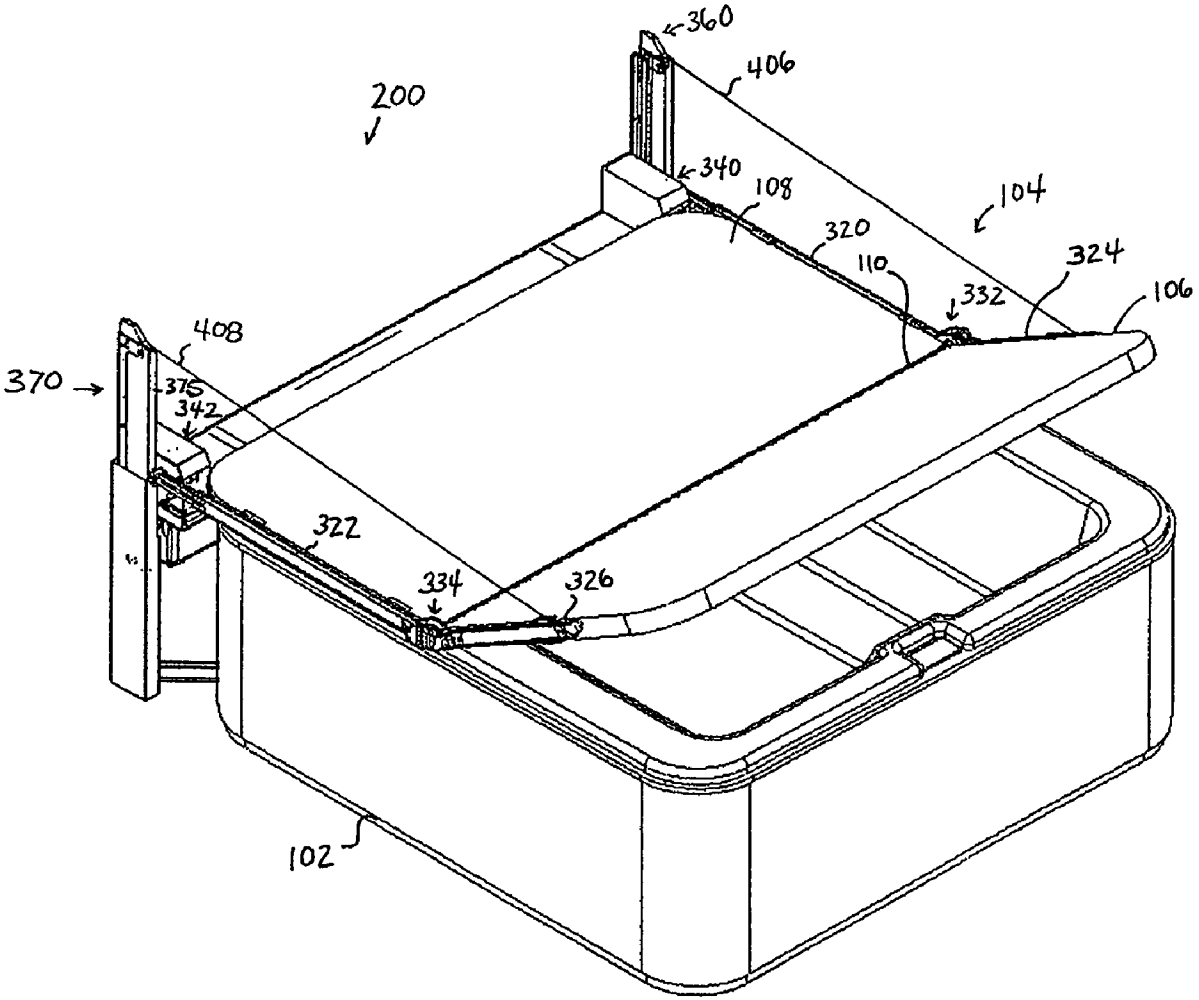
FIGS. 30-41 illustrate portions of a spa cover lifter installed on a spa according to various embodiments.
Figure 31:
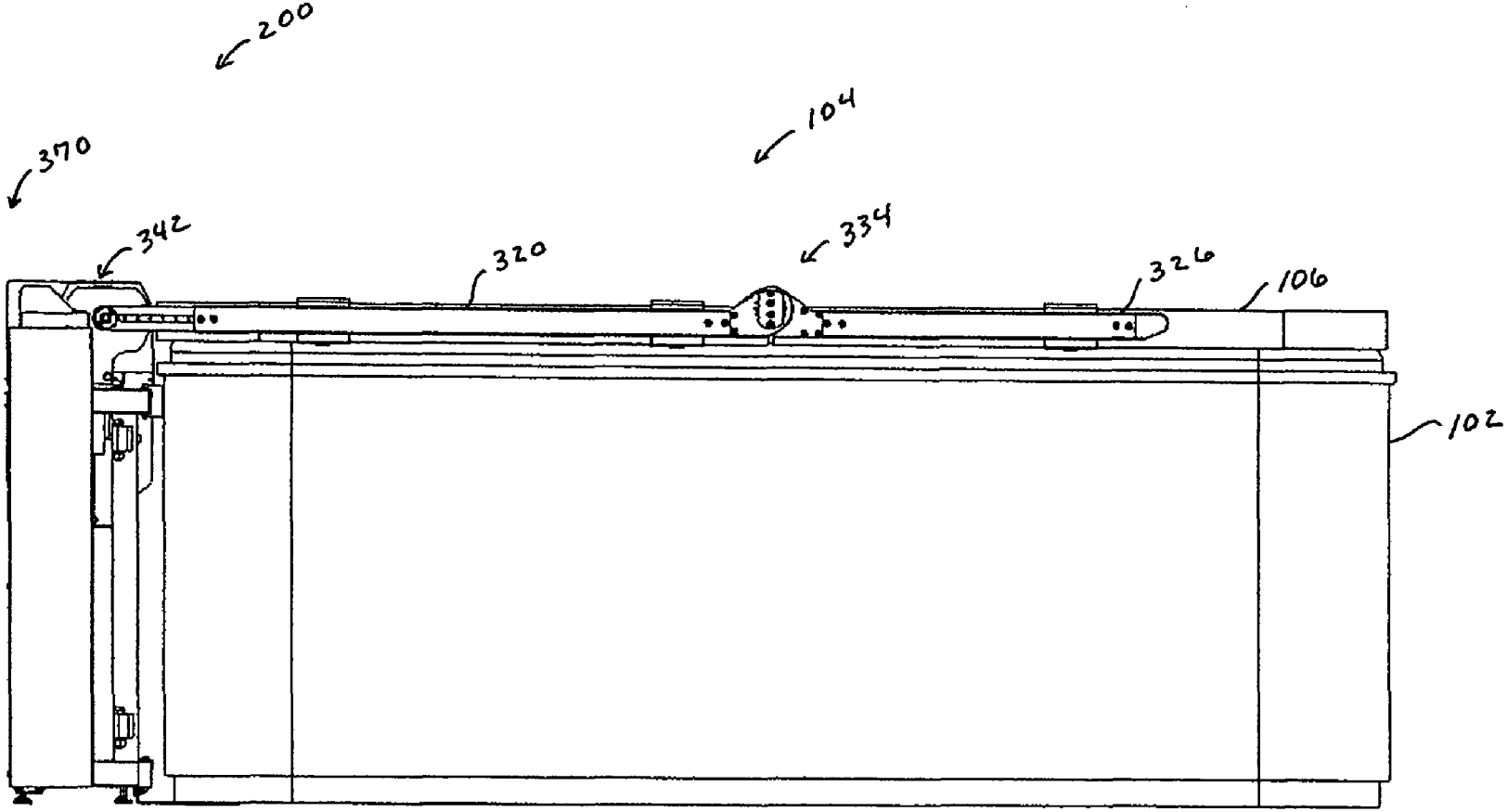
Figure 32:
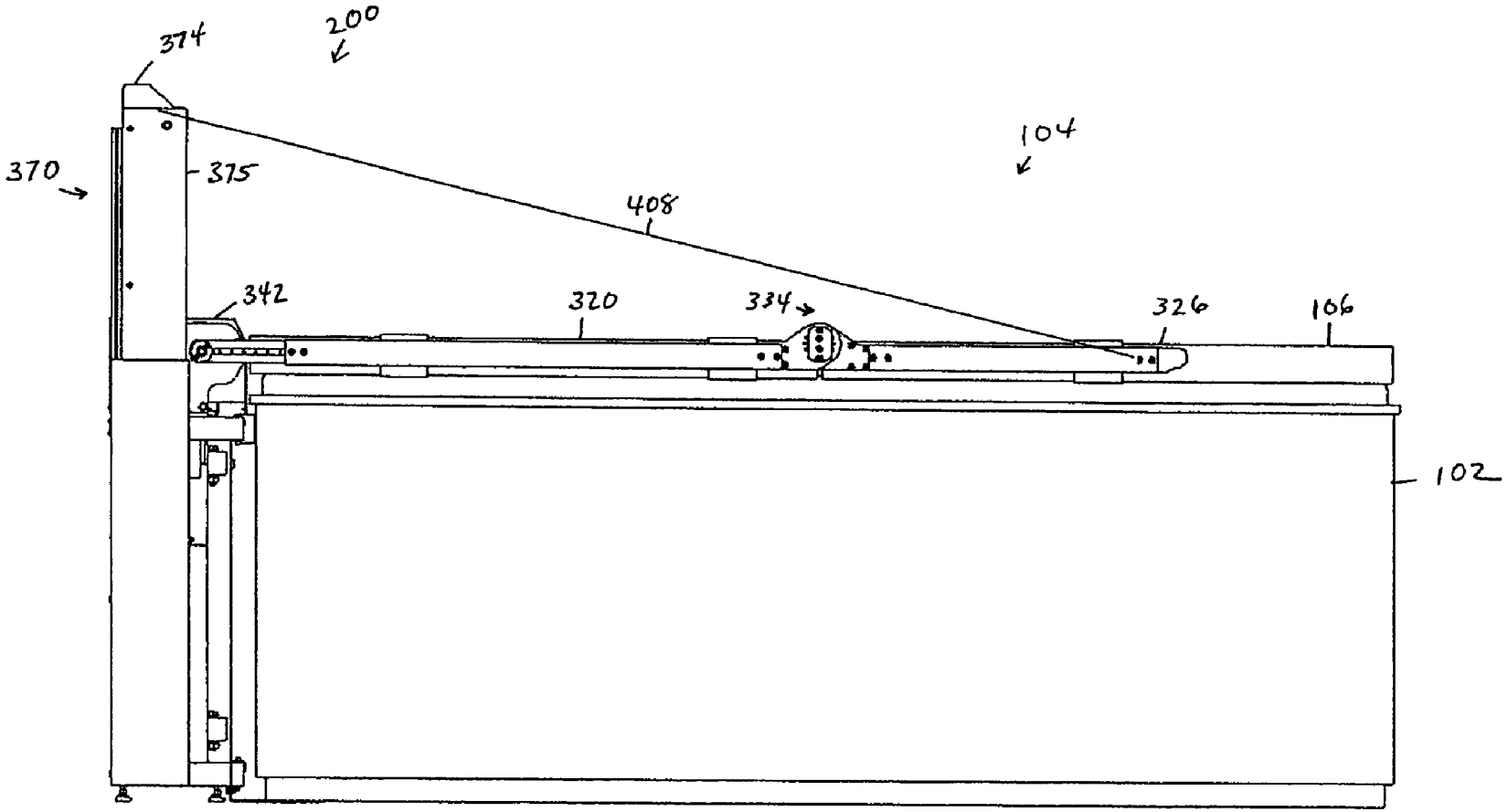

FIGS. 31-41 show a sequence of views of the spa cover lifter 200 during a process of lifting the spa cover 104. It will be appreciated that because FIGS. 31-41 are side views, some of the components of the lifter 200 shown in FIG. 30 are not shown or described. According to various embodiments, these components may be omitted, or may be present and may act similar to their symmetric components that are shown. In FIG. 31, the spa cover 104 is shown in a closed position. In this position, the cable 408 may be obscured by the frame members 320 and 326. To begin the lifting process, a drive mechanism (not shown in FIG. 31) may begin to retract the cable 408, as shown in FIG. 32. With the spa cover lifter 200 as shown, it is not necessary to coordinate the retraction of cables 408 with a central cable because no central cable is present. Accordingly, the spa cover lifter 200, as shown, may not include stops or elastic sections, as described above with reference to FIG. 17. As the cable 408 is retracted, the top member 374 of the retractable post assembly 370 may begin to extend as shown and as described above. The top member 374 is shown covered by an optional shroud 375. It will be appreciated that similar shrouds and/or cowlings may be installed to cover various other components of the lifter 200.

Figure 33:
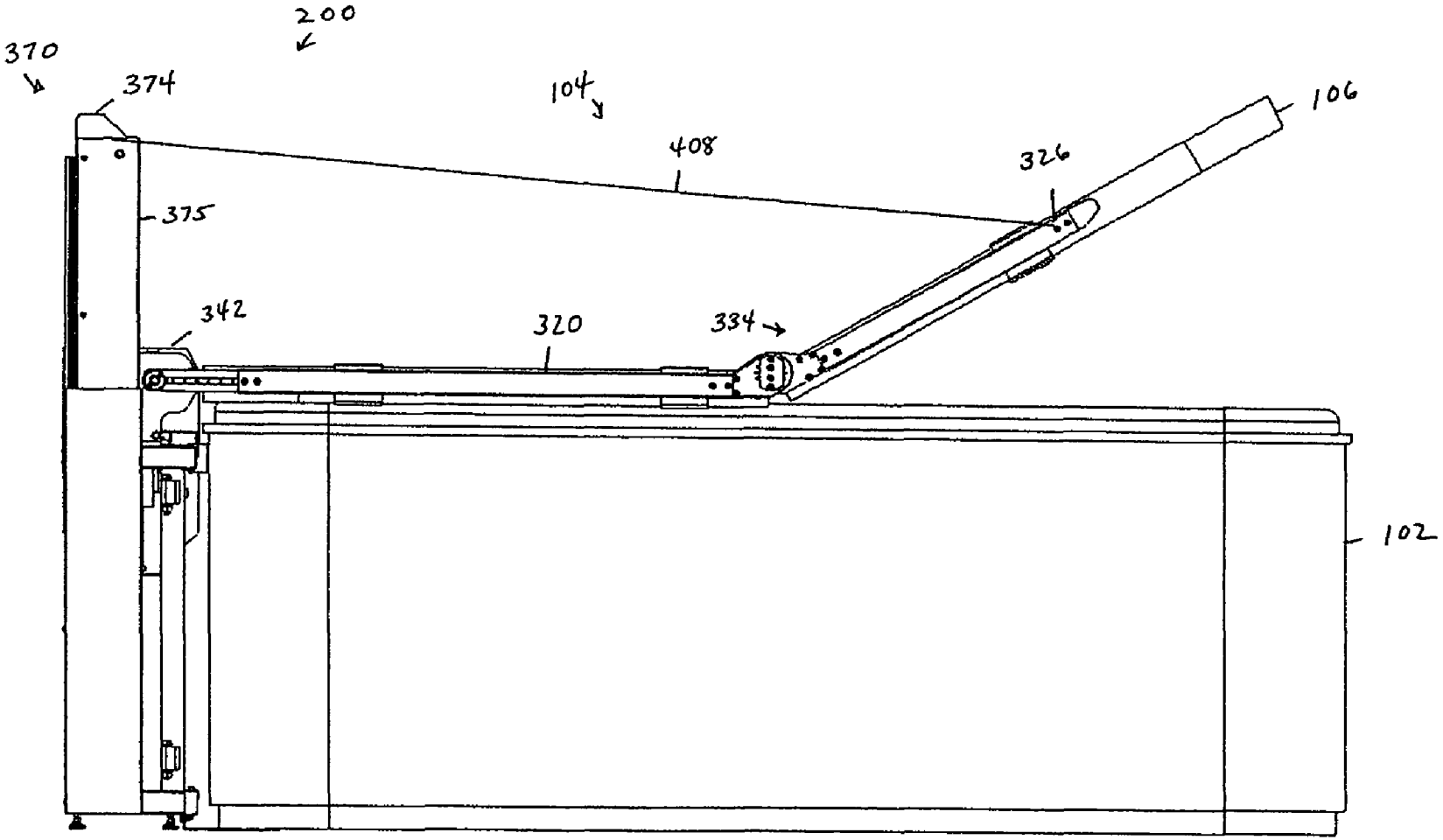
Figure 34:
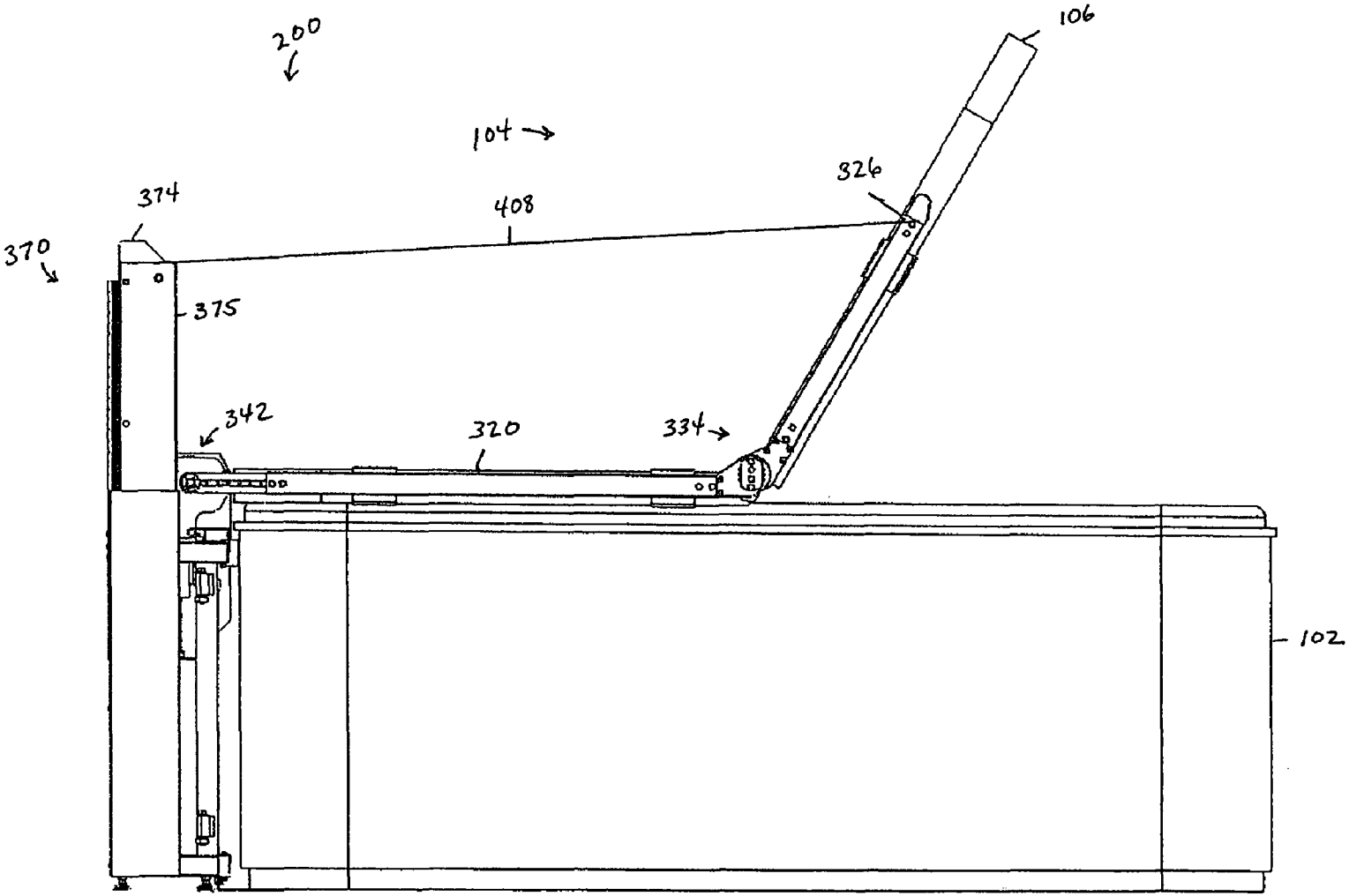
Figure 35:
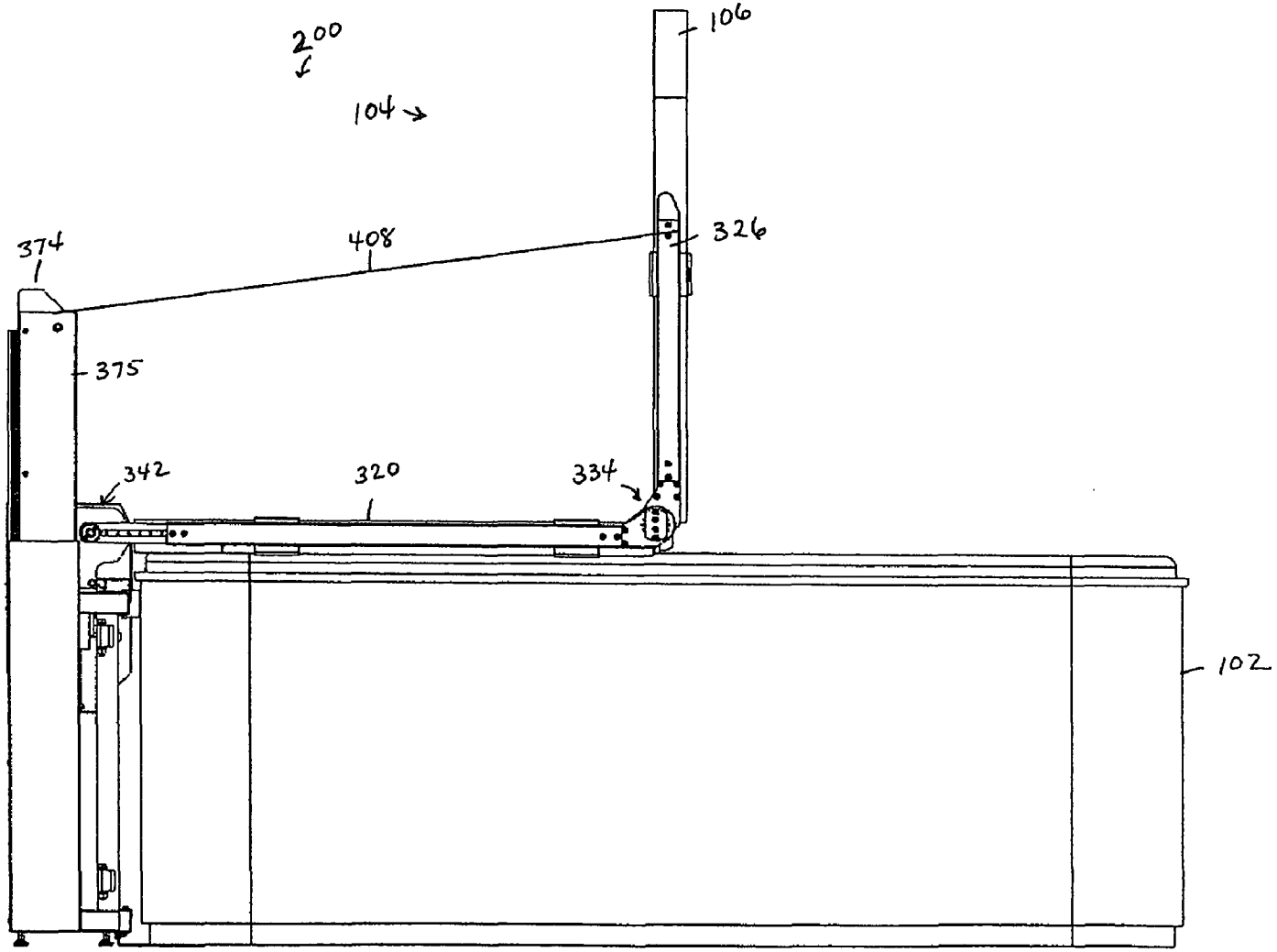
Figure 36:
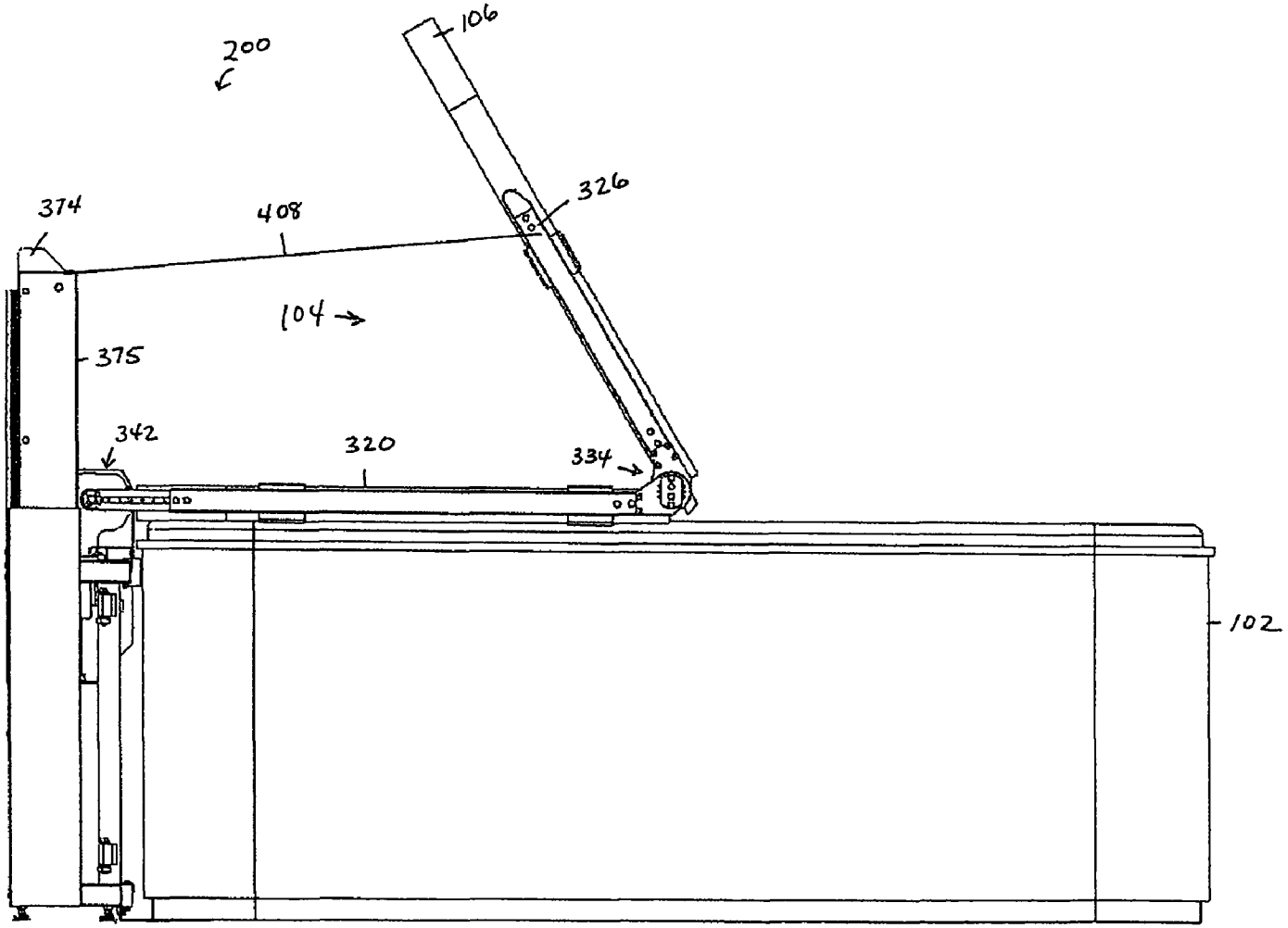
Figure 37:
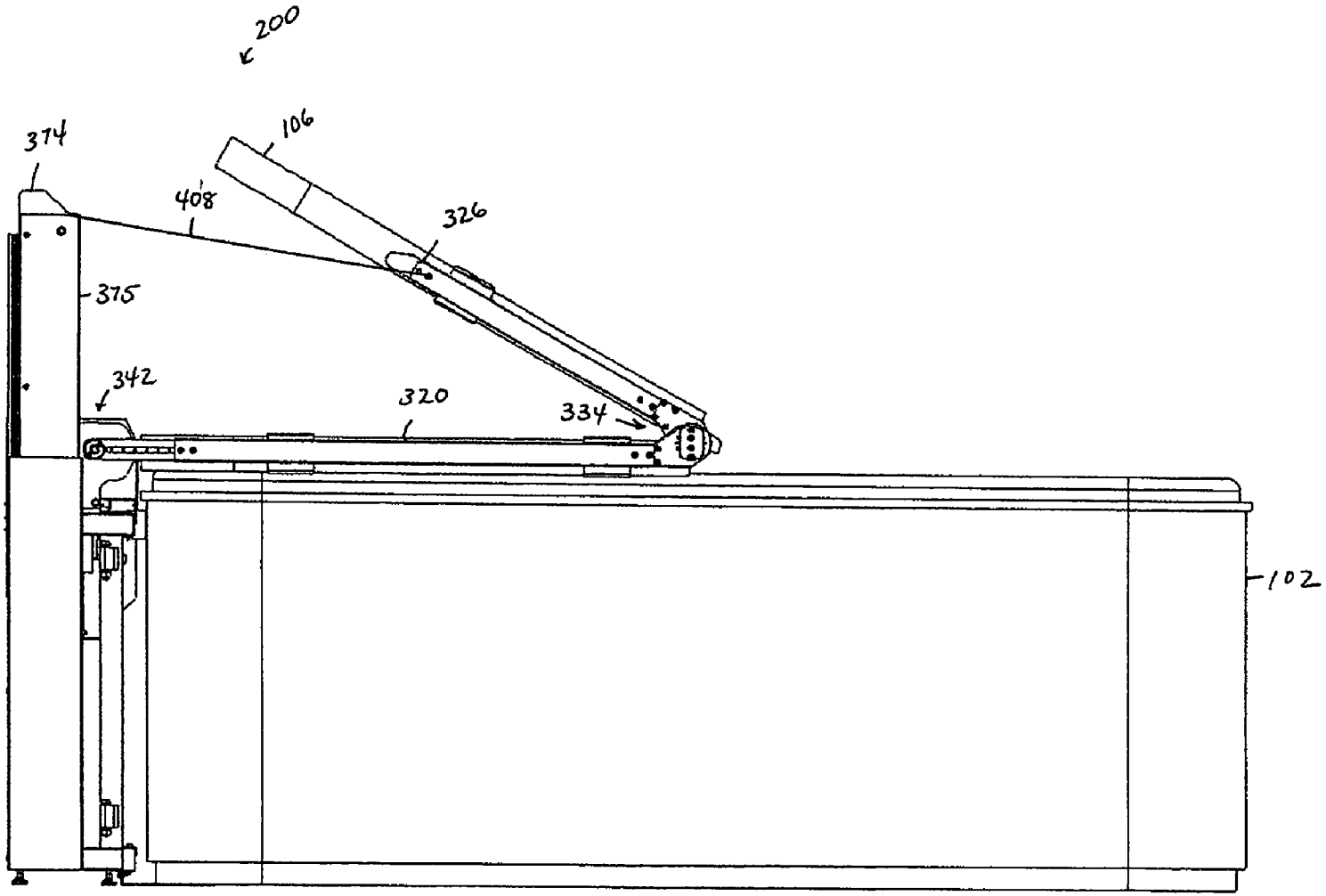
Figure 38:
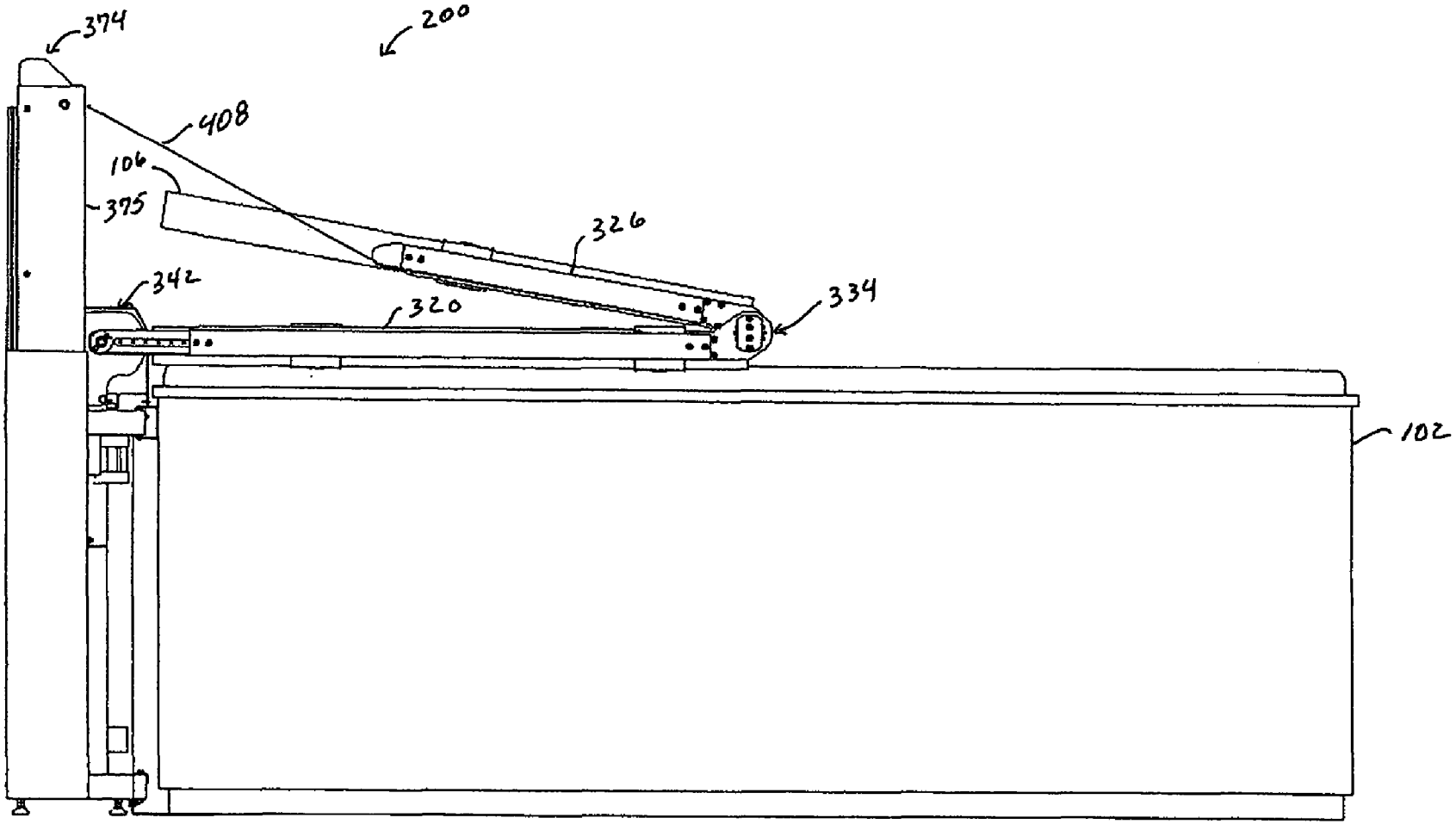

When the post assembly 370 reaches its extended position, as shown in FIG. 33, continued retraction of the cable 408 may begin to exert a force on the frame member 326 and spa cover section 106 causing the section 106 to rotate about the interface 334. According to various embodiments, the interface 334 may include a torsion spring (not shown in FIG. 33) as described above. For example, the torsion spring may be positioned to release a torque aiding the lifting of the section 106 until the section 106 reaches a predetermined angle relative to the section 108. Then the torsion spring may begin to store a second torque that may later aid in the replacement of the spa cover 104.

Figure 39:
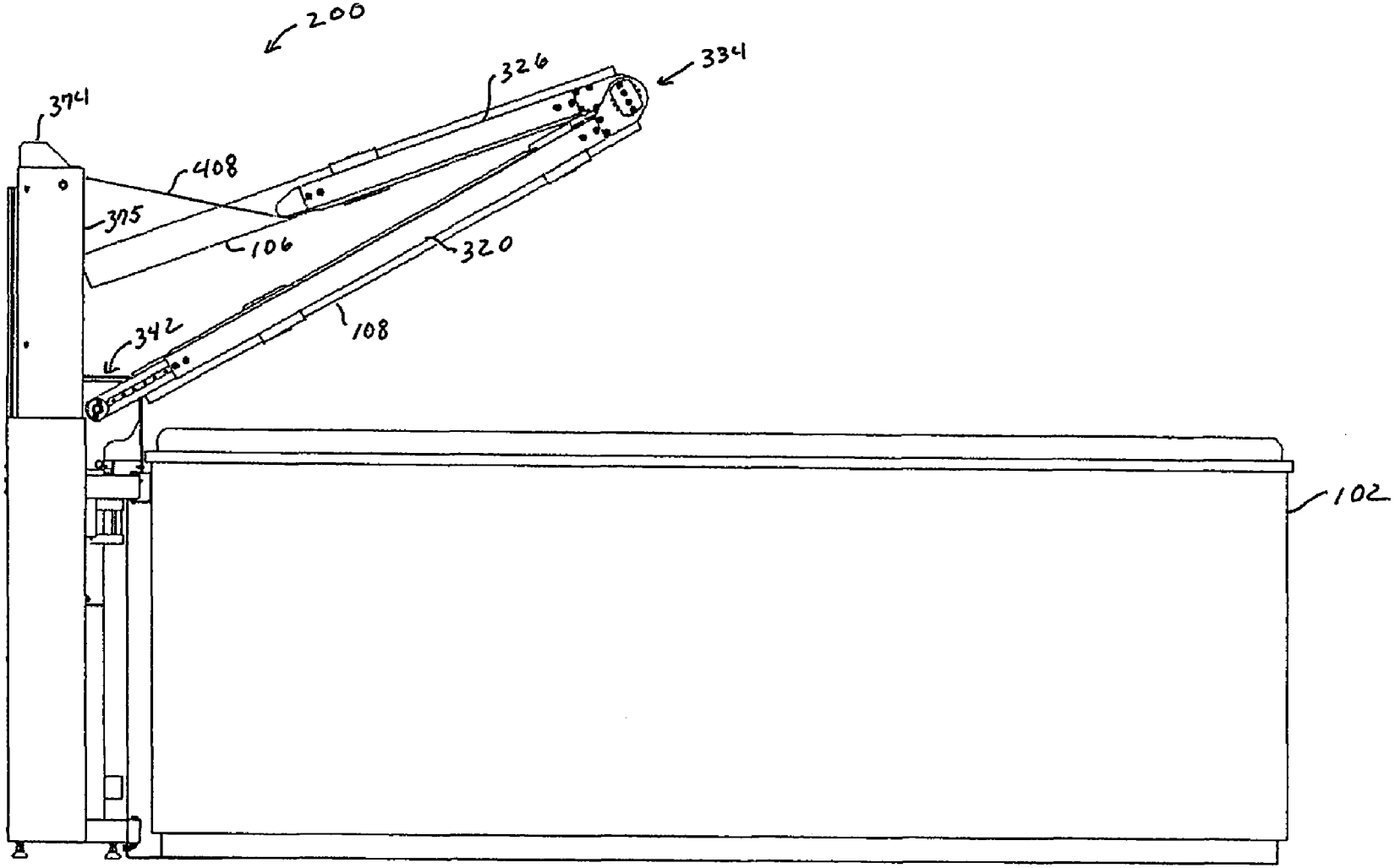
Figure 40:
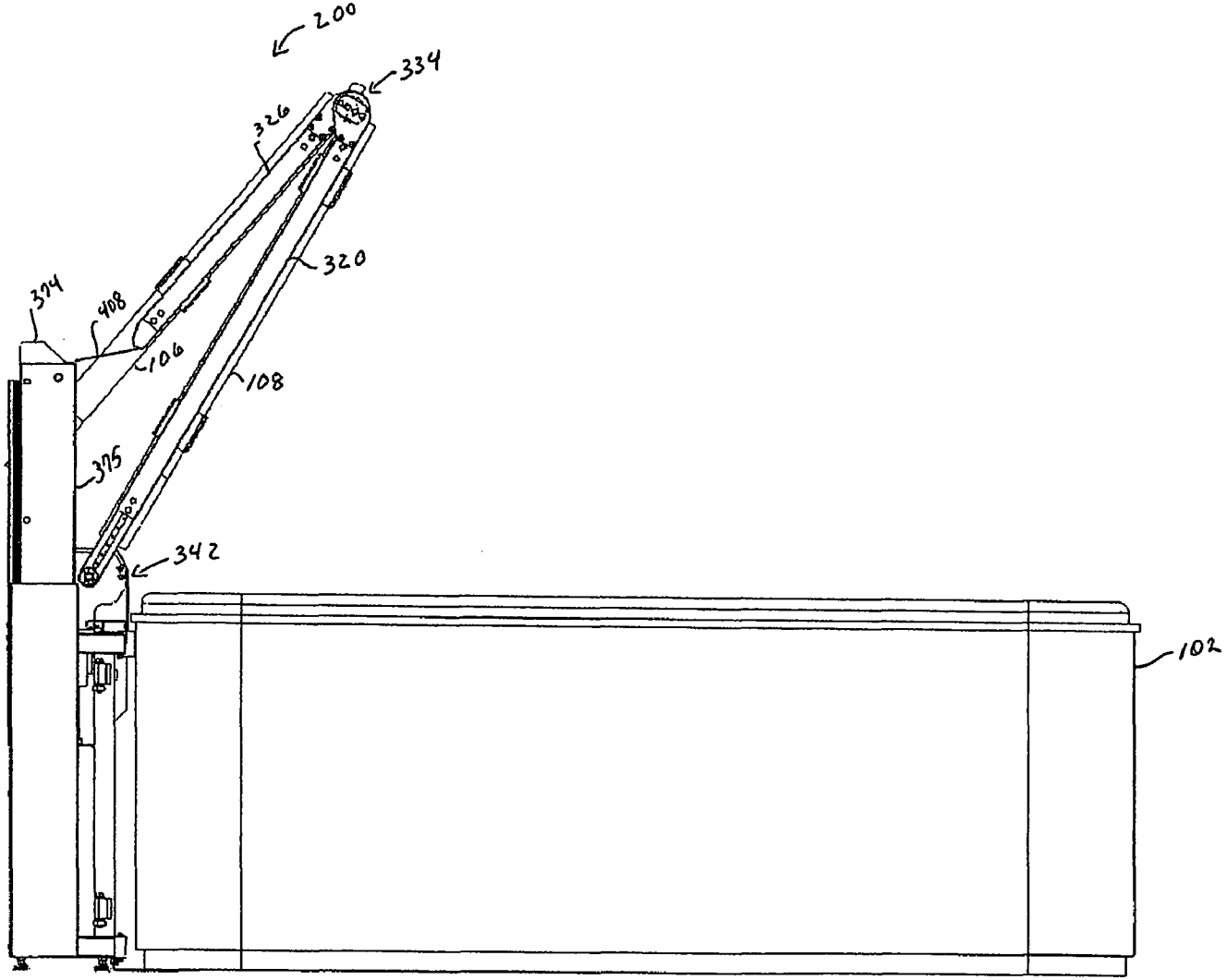
Figure 41:
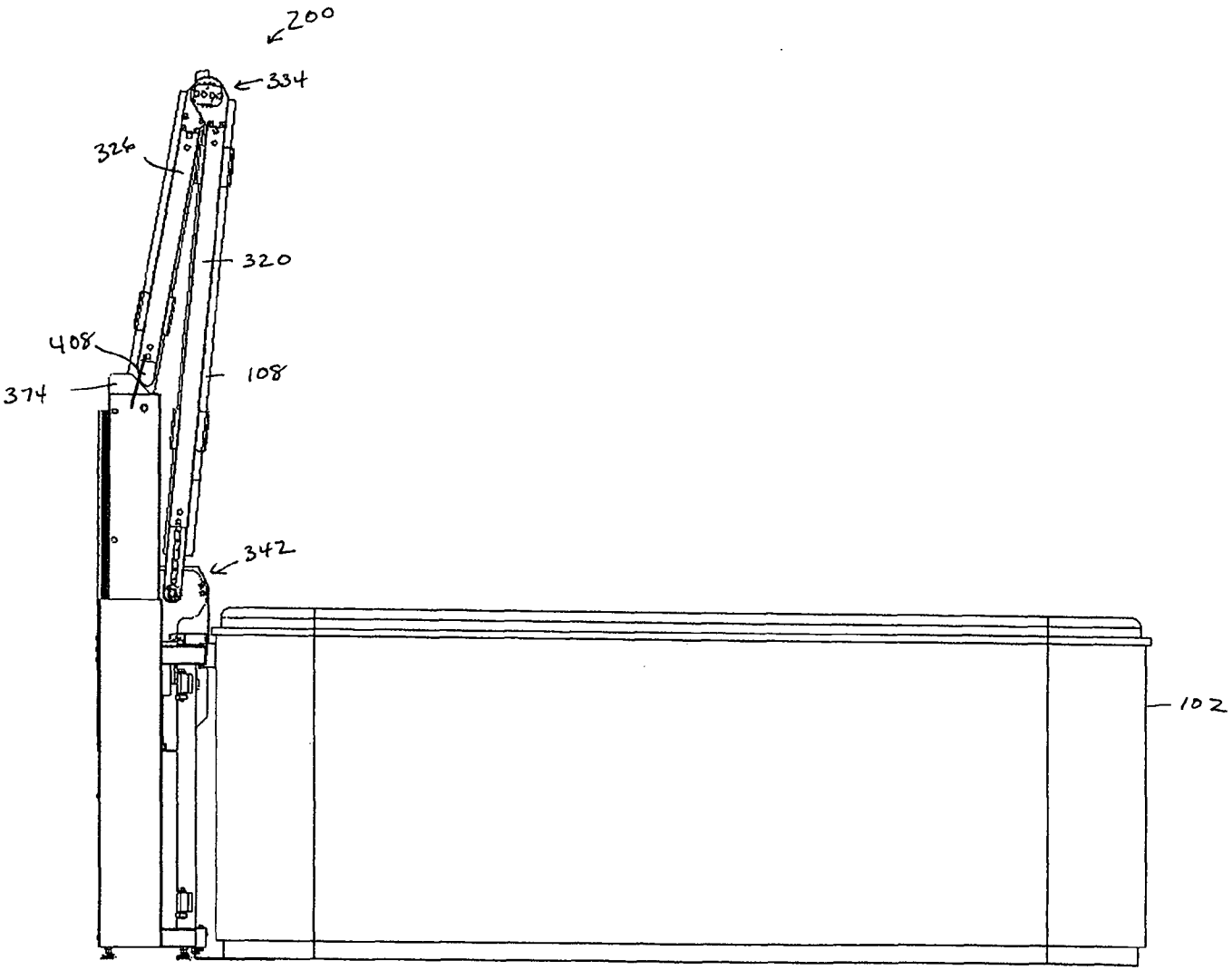

In FIGS. 34-38, the cable 408 is retracted further until it is oriented such that it provides a lifting force capable of rotating the entire spa cover 104 off of the spa 102 about interface 342. This is shown in FIG. 39. It will be appreciated that a torsion spring (not shown in FIG. 39) may be positioned at the interface 342 and may store and/or release various torques tending to aid the lifting or replacement of the cover 104. As shown in FIG. 40, the cable 408 may continue to be retracted until the spa cover 104 reaches an open position, as shown in FIG. 41.

Once open, the spa cover 104 may be replaced when the drive mechanism (not shown in FIG. 41) extends the cable 408. This may allow a torque stored at interface 342 to be released, tending to rotate the cover section 108 toward the spa 102. As the cable 408 is further extended, the second torque stored at interface 334 may tend to rotate the spa cover section 106 toward the spa 102, for example, until the spa cover 104 is in a closed position. In various embodiments, the second torque may only tend to rotate the cover section 106 toward the spa 102 until it reaches a predetermined angle relative to the spa 102. Then the first torque tending to rotate the section 106 off of the spa may be stored, for example, as described above.

While several embodiments of the invention have been described, it should be apparent that various modifications, alterations and adaptations to those embodiments may occur to persons skilled in the art with the attainment of some or all of the advantages of the present invention. For example, the number and position of the cables, pulleys, posts, etc. may vary. The instant description is therefore intended to cover all such modifications, alterations and adaptations without departing from the scope and spirit of the present invention as defined by the claims.

I claim:

1. A method of lifting a spa cover, comprising a first section and a second section pivotally coupled to the first section at a hinge interface, the method comprising:

applying a first force tending to rotate the first section of the spa cover from a position on a spa toward the second section of the spa cover;

releasing a first torque about the hinge interface tending to rotate the first section toward the second section until the first section is rotated toward the second section by a predetermined angle;

after releasing the first torque, storing a second torque tending to rotate the first section away from the second section; and applying a second force tending to rotate the spa cover off of a spa, wherein the first force and the second force are exerted through a first cable.

2. The method of claim 1, wherein applying the first force and applying the second force comprise retracting the first cable.

3. The method of claim 1, wherein the torque is stored with a cylinder.

4. The method of claim 3, wherein the cylinder is selected from the group consisting of a gas cylinder and a hydraulic cylinder.

5. The method of claim 1, wherein the torque is stored with a torsion spring.

6. The method of claim 1, wherein the torsion spring is positioned at about the hinge interface.

* * * * *